US008454123B2

(12) United States Patent
Ogawa et al.

(10) Patent No.: US 8,454,123 B2
(45) Date of Patent: Jun. 4, 2013

(54) ASSEMBLY AND IMAGE RECORDING APPARATUS

(75) Inventors: Mikio Ogawa, Nagoya (JP); Shingo Ito, Kasugai (JP); Hiroyasu Yano, Nagoya (JP); Yoichi Shikai, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 497 days.

(21) Appl. No.: 12/342,662

(22) Filed: Dec. 23, 2008

(65) Prior Publication Data

US 2009/0167792 A1 Jul. 2, 2009

(30) Foreign Application Priority Data

Dec. 28, 2007 (JP) ..... 2007-339687

(51) Int. Cl.
*B41J 25/304* (2006.01)

(52) U.S. Cl.
USPC ..... 347/37

(58) Field of Classification Search
None
See application file for complete search history.

(56) References Cited

U.S. PATENT DOCUMENTS

| | | | |
|---|---|---|---|
| 5,357,675 | A | 10/1994 | Danmoto et al. |
| 2007/0048058 | A1 | 3/2007 | Koga et al. |
| 2007/0048059 | A1 | 3/2007 | Asada et al. |
| 2007/0057447 | A1 | 3/2007 | Asada et al. |
| 2007/0231044 | A1 | 10/2007 | Koga et al. |
| 2011/0211032 | A1 | 9/2011 | Koga et al. |

FOREIGN PATENT DOCUMENTS

| | | | |
|---|---|---|---|
| JP | S59-186841 | A | 10/1984 |
| JP | H05-301133 | A | 11/1993 |
| JP | H06-011069 | U | 2/1994 |
| JP | H06-11069 | U | 2/1994 |
| JP | H09-032846 | A | 2/1997 |
| JP | 2007-090761 | A | 4/2007 |
| JP | 2007090761 | A | 4/2007 |

OTHER PUBLICATIONS

Japan Patent Office, Decision to Grant a Patent for Japanese Patent Application No. 2007-339687 (counterpart to above-captioned patent application), dispatched Nov. 22, 2011.

Japan Patent Office, Notification of Reasons for Refusal for Japanese Patent Application No. 2007-339687 (counterpart to above-captioned patent application), dispatched Sep. 6, 2011.

*Primary Examiner* — Matthew Luu
*Assistant Examiner* — Alejandro Valencia
(74) *Attorney, Agent, or Firm* — Baker Botts L.L.P.

(57) ABSTRACT

An assembly includes a frame having a first wall and a second wall, a support shaft, an elastic member, and an engaging member. The engaging member has a first engaging portion, the first wall has a recessed portion, the second wall has a second engaging portion, and the support shaft has an insertion portion. The first engaging portion and the second engaging portion are engaged with each other in a state in which the insertion portion is fitted into the recessed portion and the elastic member is compressed by the engaging member.

12 Claims, 15 Drawing Sheets

ASSEMBLY AND IMAGE RECORDING APPARATUS

CROSS REFERENCE TO RELATED APPLICATION

The present application claims priority from Japanese Patent Application No. 2007-339687, which was, filed on Dec. 28, 2007, the disclosure of which is herein incorporated by reference in its entirety.

BACKGROUND OF THE INVENTION

1. Field of the Invention

The present invention relates to an assembly in which a support shaft is supported by a frame in a state in which a plurality of members such as an elastic member are supported by the support shaft, and an image recording apparatus including the assembly. In particular, the present invention relates to a support mechanism of the support shaft by the frame.

2. Discussion of Related Art

There is known an inkjet image recording apparatus which includes a power transmission switching device that switches a power transmission from a motor as a drive source to a plurality of driven portions. As disclosed in Patent Document 1 (JP-A-2007-90761), the power transmission switching device selectively transmits a power (a drive force) to either one of the plurality of driven portions depending on a position of a recording unit that is movable above a platen. Therefore, for example, when an image is recorded on a recording sheet as a recording medium, the power is transmitted from the drive source (an LF motor) to a feeding roller which feeds a recording sheet, and when a purging operation is performed in which a foreign matter stuck in a nozzle of a recording head of the recording unit is removed, the power is transmitted from the drive source to a maintenance unit.

According to Patent Document 1, a drive force of the LF motor is transmitted to the plurality of driven portions by the power transmission switching device. The power transmission switching device includes a switching gear and four types of transmission gears such as a transmission gear for intermittent sheet-feeding, a transmission gear for consecutive sheet-feeding, transmission gear for sheet-feeding from a lower tray, and a transmission gear for maintenance operations. When a lever is positioned in either one of a first, second and third set portions (positions), the switching gear selectively meshes with corresponding one of the transmission gears corresponding to the position of the lever such that the power is transmitted to the corresponding transmission gear. The position of the lever is changed depending on a movement of a carriage in a main scanning direction corresponding to an operation mode.

The switching gear and the lever are supported by the support shaft along with a first biasing spring and a second biasing spring. More precisely, the switching gear and the lever are located on a middle portion of the support shaft, while the first biasing spring and the second biasing spring are respectively located on opposite sides of the middle portion. The support shaft is attached to the frame. Shoulders are formed in opposite ends of the support shaft. When the opposite ends of the support shaft are inserted into respective holes formed in the frame, the shoulders are respectively engaged with peripheries of the holes. The support shaft is thus mounted on the frame.

SUMMARY OF THE INVENTION

However, as disclosed in Patent Document 1, it is not an easy operation that the support shaft is attached to the frame in a state in which the switching gear, the lever, the first biasing spring, and the second biasing spring are supported by the support shaft. In other words, when the support shaft is attached to the frame, it is necessary that the switching gear and the lever are fitted on the support shaft in a state in which the first, second biasing springs are located on opposite ends of the switching gear and the lever, and the first, second biasing springs are compressed and held by an assembler. If the first, second biasing springs are not appropriately held by the assembler, or compressing forces of the springs by the assembler are smaller than elastic forces of the springs, it is possible that the first biasing spring and/or the switching gear jump out of the support shaft.

In the above-described technical background, the present invention has been developed. It is therefore an object of the present invention to provide an assembly and an image recording apparatus including the assembly in which the support shaft can be easily attached to the frame in a state in which an elastic member such as a spring is supported by the support shaft.

The above-mentioned object may be achieved according to any one of the following modes of the present invention in the form of the assembly and the image recording apparatus, each of which is numbered like the appended claims and may depend from the other mode or modes, where appropriate, to indicate and clarify possible combinations of technical features. It is, however, to be understood that the present invention is not limited to the technical features or any combinations thereof that will be described below for illustrative purposes only. It is to be further understood that a plurality of features included in any one of the following modes of the invention are not necessarily provided altogether, and that the invention may be embodied without employing at least one of the features described in connection with each of the modes.

(1) An assembly comprising:

a frame which includes a first wall and a second wall that are opposed to each other;

a support shaft which is supported by the first wall and the second wall at two respective portions of the support shaft that are spaced from each other in an axial direction thereof;

an elastic member which is supported by the support shaft;

an engaging member which is supported by the support shaft at a side of the elastic member that is closer to the second wall; and wherein the engaging member includes a first engaging portion in one of opposite sides thereof that is apart from the elastic member, wherein the first wall has a recessed portion which is formed in an inner side surface of the first wall that is opposed to the second wall, and the second wall has a second engaging portion which is engageable with the first engaging portion so as to determine a position of the engaging member relative to the second wall in at least one direction that is in parallel with a wall surface of the second wall, and a limit of movement of the engaging member in a direction away from the first wall;

wherein the support shaft includes an insertion portion in one of opposite end portions thereof that can be fitted into the recessed portion; and wherein the first engaging portion and the second engaging portion are engaged with each other in a state in which the insertion portion is fitted into the recessed portion and the elastic member is compressed by the engaging member.

The present assembly is assembled as follows. First, in a state in which the insertion portion of the support shaft is fitted into the recessed portion of the first wall by an assembler, the elastic member and the engaging member are put on the support shaft in order. At this time, the assembler presses the engaging member toward the elastic member. Thus, the elastic member can be easily compressed and can be easily maintained at a compressed state. In this state, the assembler guides to move the engaging member to an inner side of the second wall, that is, a side of the second wall that is opposed to the first wall.

In the present assembly, in a case where the support shaft has a length such that a second end portion thereof that is opposite to a first end portion as the one of opposite end portions in which the insertion portion is provided extends to an outer side of the second wall, as mentioned later, a cutout or a notch may be formed in the second wall so as to permit the support shaft to be inserted from a direction perpendicular to the axial direction. In a case where the support shaft has a length such that the second end portion is located in the inner side of the second wall, it is desirable that an end surface of the second end portion is opposed to the second wall with a small distance, and that the support shaft is prevented by the second wall from moving away from the it wall.

In any case, when the engaging member is guided to move to the inner side of the second wall by the assembler, the first engaging portion of the engaging member and the second engaging portion of the second wall are engaged with each other. After the engagement of the first, second engaging portions, even if the assembler releases the engaging member, the engagement state of the first, second engaging portions is maintained by an elastic force of the elastic member, leading to a completion of assembling of the assembly.

In the present assembly, due to an engagement of the first, second engaging portions, the engaging member is prevented from being moved relative to the second wall in at least one direction (in a direction parallel to a direction in which the cutout extends, where the support shaft is disposed in the cutout), and when the engaging member is held in contact with the second wall the limit of movement of the engaging member in the direction away from the first wall is determined based on a biasing force of the elastic member.

The first engaging portion and the second engaging portion may consist of the first connecting portion and the second connecting portion, respectively, as mentioned in the mode (2). In addition, one of the first, second engaging portions may be a simply-structured protrusion and the other may be a simply-structured engaging recess (including a through hole). In a case where each of the protrusion and the engaging recess has a circular shape in cross section, the engaging member is prevented from being rotated relative to the second wall when two pairs of the protrusions and the engaging recesses are provided. In a case where each of the protrusion and the engaging recess has a shape in cross section such that the protrusion and the engaging recess are prevented from being relatively rotated in a state of engagement of the protrusion and the engaging recess, such as a polygonal shape, one pair of the protrusion and the engaging recess function adequately. Due to an engagement of the first, second engaging portions in the present assembly, the engaging member is prevented from being moved relative to the second wall in any direction parallel to the wall surface of the second wall.

According to the above-mentioned method of assembling of the assembly, since the support shaft can be attached to the frame without the frame being bent (deformed), the frame can be made of a rigid material. As a result, an axis of the support shaft can be positioned accurately, and positional accuracy of members that are supported by the support shaft is improved.

(2) The assembly according to the mode (1), wherein the engaging member includes a first connecting portion as the first engaging portion, and the second wall includes a second connecting portion as the second engaging portion that is connectable with the first connecting portion, and wherein the first connecting portion and the second connecting portion are connected with each other.

In the present assembly, when the first connecting portion and the second connecting portion are connected with each other, the engaging member is connected with the second wall, so that a portion (for instance, the second end portion) of the support shaft that is away from the first end portion is supported by the engaging member. In other words, the second end portion of the support shaft is supported by the second wall via the engaging member.

(3) The assembly according to the mode (1), wherein the second wall includes a cutout which is formed from one of opposite end edges of the second wall toward a center thereof, and the support shaft includes an engaging groove that is engageable with an edge portion of the cutout, and wherein, when the engaging groove and the edge portion of the cutout are engaged with each other, a position of the support shaft in the axial direction is determined and a movement of the support shaft in a direction perpendicular to a direction in which the cutout extends is prevented.

In the present assembly, the insertion portion of the support shaft is inserted into the recessed portion of the first wall, so that the first end portion of the support shaft is supported by the first wall. The engaging groove is engaged with the edge portion of the cutout, so that the portion that is away from the first end portion is supported by the second wall and the position of the support shaft in the axial direction is determined. That is, the support shaft is supported by the frame with stability at two positions of the frame that are spaced from each other in the axial direction.

(4) The assembly according to the mode (3), wherein the engaging groove is formed in the other end portion of the support shaft that is opposite to the one end portion in which the insertion portion is formed.

In the present assembly, opposite end portions of the support shaft are supported by the first wall and the second wall, respectively.

(5) The assembly according to the mode (1), wherein the engaging member includes a first connecting portion as the first engaging portion, the second wall includes a cutout which is formed from one of opposite end edges of the second wall toward a center thereof and a second connecting portion as the second engaging portion that is provided in the vicinity of the cutout, and the support shaft includes an engaging groove, and wherein, in a state in which the engaging groove and an edge portion of the cutout are engaged with each other, the first connecting portion and the second connecting portion are connected with each other.

In the present assembly, both of the mode (2) and the mode (3) are adopted, so that the support shaft is more certainly supported by the first wall and the second wall.

However, the engagement of the engaging groove and the edge portion of the cutout prevents the support shaft from moving in the axial direction relative to the second wall and moving in the direction perpendicular to the direction in which the cutout extends, so that the engaging member may be engaged with the second wall at least in a state in which the support shaft is prevented from being disengaged from the cutout. Therefore, it is not necessary that the first, second connecting portions are provided as in the present mode.

(6) The assembly according to any of the modes (1) through (5), wherein the engaging member further includes a handle portion which extends in a direction away from the support shaft.

In the present assembly, the handle portion is provided in the engaging member. Thus, since the assembler holds the handle portion to operate the engaging member, a series of operations can be easily performed. The operations include a process in which the elastic member is compressed, another process in which a compressed state of the elastic member is maintained, and a further process in which the engaging member is engaged with the second wall in a state in which the compressed state of the elastic member is maintained.

(7) The assembly according to the mode (5) or the mode (6), wherein the second connecting portion includes a bridge portion which is provided in an outer space of the second wall that is opposite to the first wall and extends over the cutout, and wherein the first connecting portion includes a pair of holding claws which nip and hold the bridge portion from both sides in a direction parallel to a direction in which the cutout extends.

In the present assembly, a portion of the frame in which the cutout is formed can be strengthened (reinforced) by (with) the bridge portion, so that rigidity of the frame is improved.

In the present assembly, it is necessary that the support shaft has a length which permits the second end of the support shaft to pass through an inner space of the bridge portion and be insertable into the cutout.

(8) The assembly according to the mode (7), wherein at least one of the pair of holding claws is elastically deformable so as to be movable away from the other of the holding claws and has an engaging protrusion which protrudes from a surface of the one holding claw that is opposed to the other holding claw toward the other holding claw, and wherein elastically deforming of the at least one holding claw permits that the engaging protrusion and the bridge portion are engaged with each other.

Since the engaging member is pressed on the second wall by a biasing force of the elastic member, it is not indispensable that the engaging protrusion and the bridge portion are engaged with each other, however, when the engaging protrusion and the bridge portion are engaged with each other, the engaging member can be connected with the second wall with high certainty or reliability.

(9) The assembly according to the mode (7) or the mode (8), wherein at least one of the pair of holding claws that is close to the support shaft extends through the cutout to an outside of the second wall and holds the bridge portion.

In the present assembly, the bridge portion can be located in a position of the second wall corresponding to the cutout and can be also engaged with at least one of the pair of holding claws.

(10) The assembly according to any of the modes (7) through (9), wherein at least one of the pair of holding claws functions as a handle portion that is held by fingers of an assembler for moving the engaging member.

In the present assembly, at least one of the pair of holding claws also function as a handle portion, so that a structure of the engaging member can be simplified.

(11) The assembly according to any of the modes (3) through (5), wherein the cutout includes a first cutout portion adjacent to the one of opposite end edges of the second wall and a second cutout portion which is connected to one of opposite ends of the first cutout portion that is remote from the one end edge of the second wall, and wherein a width of the second cutout portion is smaller than that of the first cutout portion, and the engaging groove is engageable with an edge portion of the second cutout portion.

In the present assembly, when the support shaft is fitted into the second cutout portion, the support shaft is guided by the first cutout portion, so that an operation (an insertion of the support shaft into the second cutout portion) can be easily performed.

(12) The assembly according to any of the modes (1) through (11), wherein the recessed portion is a through hole which is formed through the first wall, and a diameter of the insertion portion of the support shaft is smaller than that of an adjacent portion that is adjacent to the insertion portion such that a shoulder is formed between the insertion portion and the adjacent portion, and wherein, when the shoulder is come into contact with the inner side surface of the first wall, a limit of inserting of the insertion portion into the through hole is determined.

In the present assembly, when the insertion portion is inserted into the through hole, the shoulder is come into contact with an edge of the through hole and the support shaft can be maintained at a state in which the support shaft stands up from the first wall. As a result, respective members can be easily put on the support shaft.

(13) The assembly according to any of the modes (1) through (12), wherein a switching gear and a switching member are supported by the support shaft on a side of the elastic member that is opposite to the engaging member, and wherein, when the switching member is operated to move the switching gear in a direction toward the engaging member against an elastic force of the elastic member, a position of the switching gear on the support shaft is changed.

(14) An image recording apparatus comprising;

a carriage which supports a recording head and is reciprocateable in a main scanning direction, a feeding device which feeds a recording medium in a sub scanning direction that is perpendicular to the main scanning direction, a switching gear which is driven and rotated by a drive force of a drive source, a plurality of transmission gears which are arranged to be selectively meshed with the switching gear and transmit the drive force to corresponding one of a plurality of driven portions, a switching member which is operated to selectively move the switching gear to respective one of a plurality of positions in which the switching gear meshes with corresponding one of the plurality of transmission gears, a support shaft which is inserted into the switching gear, the switching member and an elastic member and supports the switching gear and the switching member so as to be slidable in a direction parallel to the main scanning direction, an engaging member, the elastic member which is supported by the support shaft along with the engaging member and biases (1) the switching gear and the switching member and (2) the engaging member in a direction in which (1) the switching gear and the switching member and (2) the engaging member move away from each other, and a frame which has a first wall and a second wall that are opposed to each other and supports the support shaft by the first wall and the second wall, and wherein the frame, the elastic member, the support shaft, the engaging member, the switching gear and the switching member constitutes the assembly according to any of the modes (1) through (13).

In the present image recording apparatus, an operation in which the support shaft is attached to the frame can be easily performed.

(15) The image recording apparatus according to the mode (14), including a first drive source and a second drive source as the drive source, and, as the switching gear, a first switching gear which is rotated by a drive force from the first drive source and a second switching gear which is rotated by a drive force from the second drive source.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Figure 1:
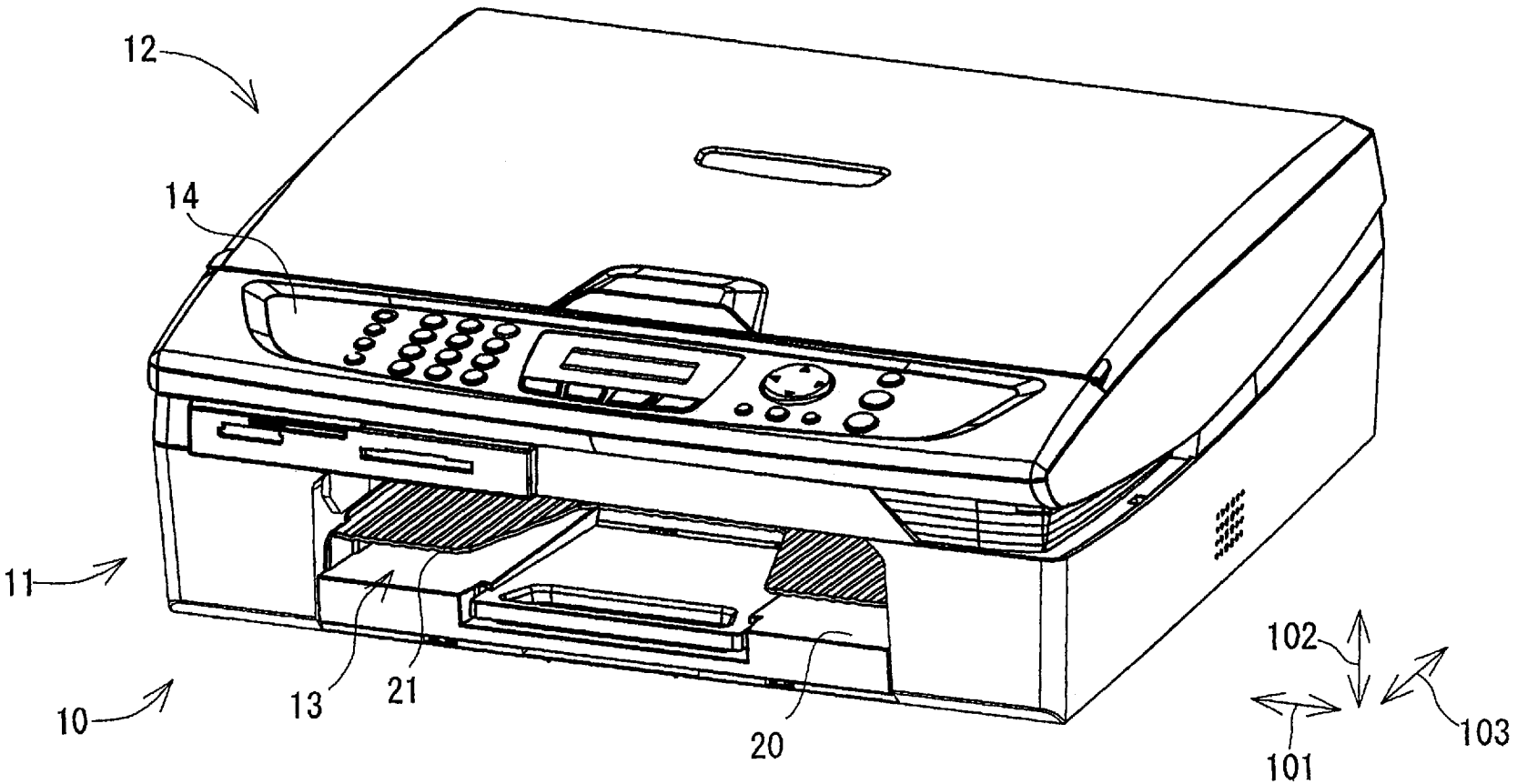
FIG. 1 is a perspective view as seen from a front side showing a structure of appearance of a multi-function device (MFD) as one embodiment to which the present invention is applied.
Figure 2:
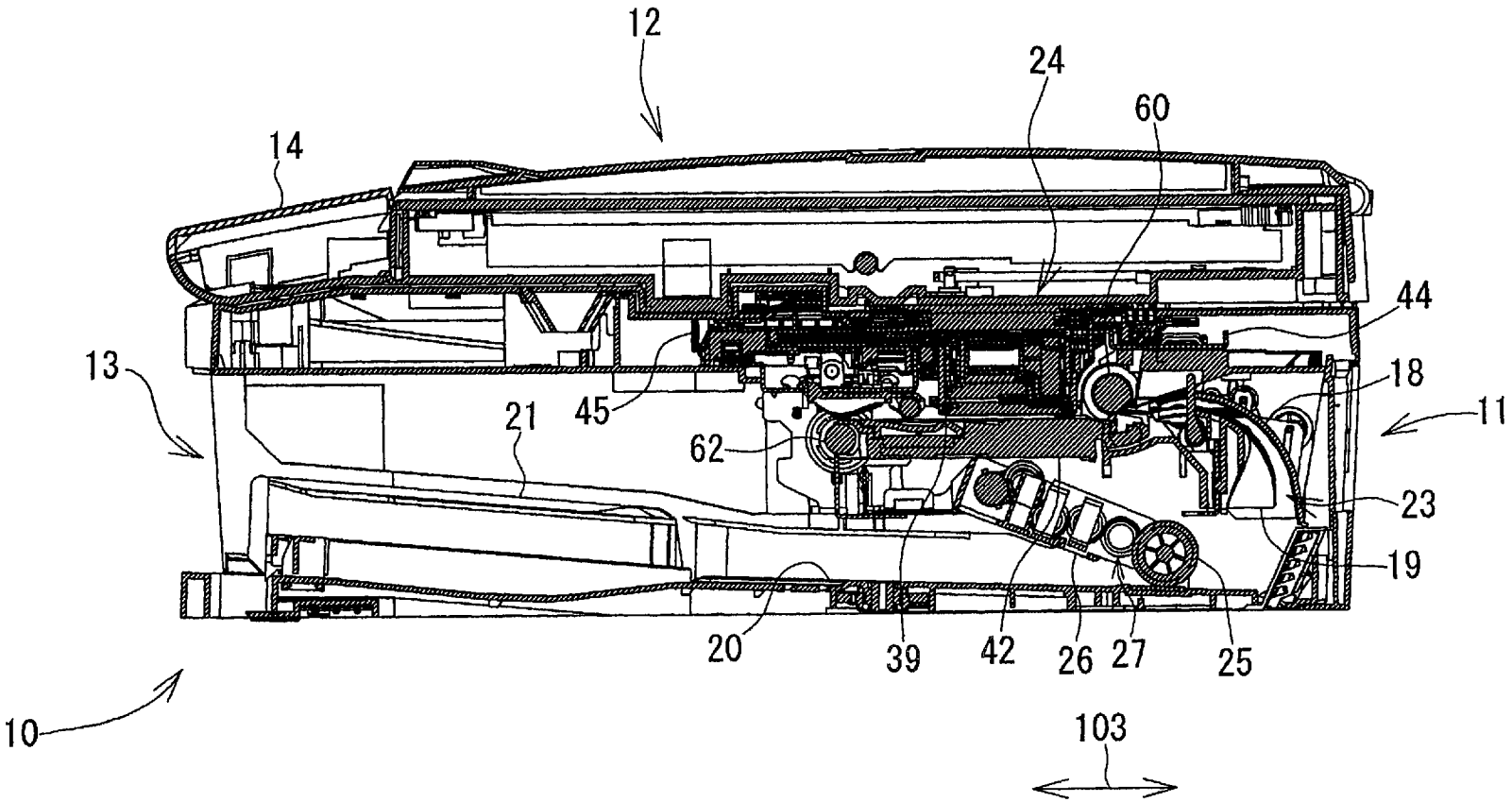
FIG. 2 is a side cross-sectional view of an internal structure of the MFD.

Hereinafter, there will be described preferred embodiments of the present invention with reference to the drawings. As shown in FIGS. 1 and 2, a multi-function device (MFD) 10 includes a printer portion 11 and a scanner portion 12, and has a printer function, a scanner function, a copier function and a facsimile-machine function. The printer portion 11 corresponds to the image recording apparatus to which the present invention is applied. The functions other than the printer function may be selected, for example, the scanner portion 12 may be omitted. Thus, the present invention may be applied to a single-function printer that has only the printer function and does not have the scanner, copier or facsimile-machine function.

The printer portion 11 is provided in a lower portion of the MFD 10, and the scanner portion 12 is provided in an upper portion thereof that is integral with the lower portion. The printer portion 11 is mainly connected to an external data-processor device such as a computer, so that the printer portion 11 can record, based on printing data (recording data) including image data and document data supplied from the computer, images and/or letters on a recording sheet as a recording medium. The scanner portion 12 is a so-called "flat-bed" scanner.

As shown in FIG. 1, a width indicated by an arrow 101) and a length Indicated by an arrow 103) of the MFD 10 are greater than a height thereof (indicated by an arrow 102). Thus, the MFD 10 has a generally rectangular parallelepiped shape. The printer portion 11 includes a front opening 13 formed in a front surface of the MFD 10. A sheet-feed tray 20 and a sheet-discharge tray 21 are exposed through the front opening 13. The recording sheets accommodated by the sheet-feed tray 20 are supplied, one by one, to the printer portion 11, so that after a desired image is recorded on each recording sheet, the each sheet is discharged onto the sheet-discharge tray 21. In the following description of each of the components, a portion, an end, or a side of the each component which is located nearer to the front opening 13 will be referred to as a front portion, a front end, or a front side of the each component, and a portion, an end, or a side of the each component which is located opposite to the front opening 13 will be referred to as a rear portion, a rear end, or a rear side of the each component.

An operation panel 14 is provided in a front end portion of the upper portion of the MFD 10. The operation panel 4 is for operating the printer portion 11 and the scanner portion 12. The operation panel 14 includes various operation keys that are used by a user or an operator to input various commands to operate the MFD 10 and a display that displays a state of the MFD 10, an error indication and so on. In the case where the MFD 10 is connected to the above-described computer, the MFD 10 is operated according to commands supplied from the computer via communication software such as a printer driver or a scanner driver.

As shown in FIG. 2, the sheet-feed tray 20 is disposed in a bottom portion of the MFD 10. The sheet-discharge tray 21 is disposed above the sheet-feed tray 20. In other words, the sheet-feed tray 20 and the sheet-discharge tray 21 have a vertically stacked structure. The sheet-feed tray 20 and the sheet-discharge tray 21 are connected to each other through a sheet-feed path 23 such that the recording sheets can be fed from the sheet-feed tray 20 to the sheet-discharge tray 21. The recording sheets that are accommodated by the sheet-feed tray 20 are fed to an image recording unit 24, guided by a U-turn portion of the sheet-feed path 23 through which the direction of feeding of each recording sheet is changed from a rearward direction to a frontward direction before the each recording sheet is fed to the image recording unit 24. After the image recording unit 24 records the image on the each recording sheet, the each sheet is discharged onto the sheet-discharge tray 21.

The sheet-feed tray 20 has a dish-like shape which includes a plurality of (four in the present embodiment) side walls standing upright from a periphery of a tray surface. The tray surface has an area in which the recording sheets are stacked on each other. The sheet-feed tray 20 can accommodate the plurality of recording sheets that are of a size, for example, not larger than A3 size (defined by JIS), A4 size, B5 size, and Postcard size.

The sheet-discharge tray 21 has a tray-like shape, and the each recording sheet on which an image is recorded is discharged onto an upper surface of the sheet-discharge tray 21. The sheet-discharge tray 21 is located on the front side of the sheet-feed tray 20 in a lengthwise direction of the MFD 10 (a direction indicated by the arrow 103). Therefore, the sheet-discharge tray 21 is not disposed above the sheet-feed tray 20 in the rear side of the MFD 10.

The sheet-feed roller 25 is provided in the rear side of the MFD 10. The sheet-feed roller 25 supplies each recording sheet stacked in the sheet-feed tray 20 to the sheet-feed path 23. A drive force or a rotation force of an ASF (Auto Sheet Feed) motor 28 is transmitted to the sheet-feed roller 25 through a gear line 27 which includes a plurality of gears meshed with each other such that the sheet-feed roller 25 is rotated about a rotation axis. The sheet-feed roller 25 is rotatably supported by a lower or distal end portion of a sheet-feed arm 26. The sheet-feed arm 26 is pivotable about a rotation axis such that the distal end portion thereof where the sheet-feed roller 25 is supported functions as a distal end of a pivot, so that the sheet-feed roller 25 is movable upward and downward or movable away from and toward the sheet-feed tray 20. The sheet-feed arm 26 is pivoted downward because of a weight thereof or a biasing force of a spring and is pivoted upward depending on an amount of the recording sheets stacked in the sheet-feed tray 20. Therefore, the sheet-feed roller 25 is in contact with an uppermost one of the recording sheets in the sheet-feed tray 20. When the sheet-feed roller 25 is rotated in this state, due to a friction force between a roller surface of the sheet-feed roller 25 and the uppermost recording sheet, the uppermost recording sheet is fed to the sheet-feed path 23.

The sheet-feed path 23 first extends upward from a rear portion of the MFD 10, and then curves toward the front side of the MFD 10. That is, the sheet-feed path 23 extends from the rear side of the MFD 10 toward the front side thereof via the image recording unit 24, and further extends to the sheet-discharge tray 21. Except for a portion of the sheet-feed path 23 where the image recording unit 24 is provided, the sheet-feed path 23 is defined and constituted by an outer guide surface and an inner guide surface that are opposed to each other with an appropriate distance therebetween. For example, at the U-turn portion of the sheet-feed path 23, the sheet-feed path 23 is constituted by an outer guide member 18 and an inner guide member 19 which are fixed to each other inside a frame of the MFD 10.

The image recording unit 24 is provided in the sheet-feed path 23. The image recording unit 24 includes a recording head 39 and carriage 38 as the carriage in the present invention that carries the recording head 39 and that can be moved or reciprocated in a main scanning direction. Different colors of inks which are stored in respective ink cartridges that are disposed in the MFD 10 are supplied to the recording head 39 via respective ink tubes 41. While the carriage 38 is reciprocated along a predetermined movement path in the main scanning direction, the recording head 39 selectively ejects droplets of the inks toward each recording sheet being fed onto the platen 42. Thus, a desired image is recorded on the recording sheet. A detailed construction of the image recording unit 24 will be described later.

A feed roller 60 and a pinch roller are provided on an upstream side of the image recording portion 24 in a sheet feed direction in which each recording sheet is fed from the tray 20. Although the pinch roller is not shown in FIG. 2 behind other members, the pinch roller is disposed below the feed roller 60 with being held in pressed contact with the feed roller 60. The feed roller 60 is intermittently driven or rotated based on a drive force or a rotation force from an LF (Line Feed) motor 61 so as to feed the recording sheet, with an amount of each intermittent motion of the recording sheet corresponding to an amount of each image line. The feed roller 60 and the pinch roller cooperate with each other to nip the recording sheet fed along the sheet-feed path 23 and to feed the recording sheet onto a platen 42.

A sheet discharge roller 62 and a spur roller are provided on a downstream side of the image recording portion 24 in the sheet feed direction. Though the spur roller is not shown in FIG. 2 behind other members, the spur roller is disposed above the sheet discharge roller 62 with being held in pressed contact with the sheet discharge roller 62. The sheet discharge roller 62 is, similarly to the feed roller 60, intermittently driven or rotated by the LF motor 61 so as to feed the recording sheet, by each incremental amount corresponding to each line of image. The sheet discharge roller 62 and the spur roller cooperate with each other to nip the recording sheet to which the droplets of inks have been applied and to convey the recording sheet onto the sheet-discharge tray 21.

As shown in FIG. 8, a pair of guide rails 43, 44, provided above the sheet-feed path 23, are distant from each other by an appropriate distance in the sheet feed direction, and extend parallel with each other in a direction perpendicular to the sheet-feed direction (in a direction indicated by the arrow 101). The two guide rails 43, 44 are disposed in an inner space of a casing of the printer portion 11, the guide rails 43, 44 each as a part of a frame that supports members constituting the printer portion 11. The carriage 38 bridges the two guide rails 43, 44 such that the carriage 38 is slidable in the direction perpendicular to the sheet feed direction.

The guide rail 43, which is provided on an upstream side of the guide rail 44 in the sheet feed direction, has such an elongate, flat structure that a length thereof measured in a widthwise direction of the sheet-feed path 23 (in the direction indicated by the arrow 101) is larger than a length of a range of the reciprocating movement of the carriage 38. The guide rail 44, which is provided on a downstream side of the guide rail 43 in the sheet feed direction has a flat structure that a length thereof measured in the widthwise direction of the sheet-feed path 23 is the same as that of the guide rail 43. An upstream portion of the carriage 38 in the sheet feed direction is mounted on an upper surface of the guide rail 43, while a downstream portion of the carriage 38 is mounted on an upper surface of the guide rail 44, such that the carriage 38 is supported and guided by the two guide rails 43, 44 to slide in a lengthwise direction of the guide rails 43, 44. An edge portion 45 is provided by an upstream end portion of the guide rail 44 in the sheet feed direction that is bent perpendicularly and upwardly. The carriage 38 which is supported by the guide rails 43, 44 slidably grips the edge portion 45 by pinch members such as a pair of rollers. Thus, the carriage 38 is prevented from being displaced in the sheet feed direction, while being slidably moved in the direction perpendicular to the sheet feed direction.

Figure 3:
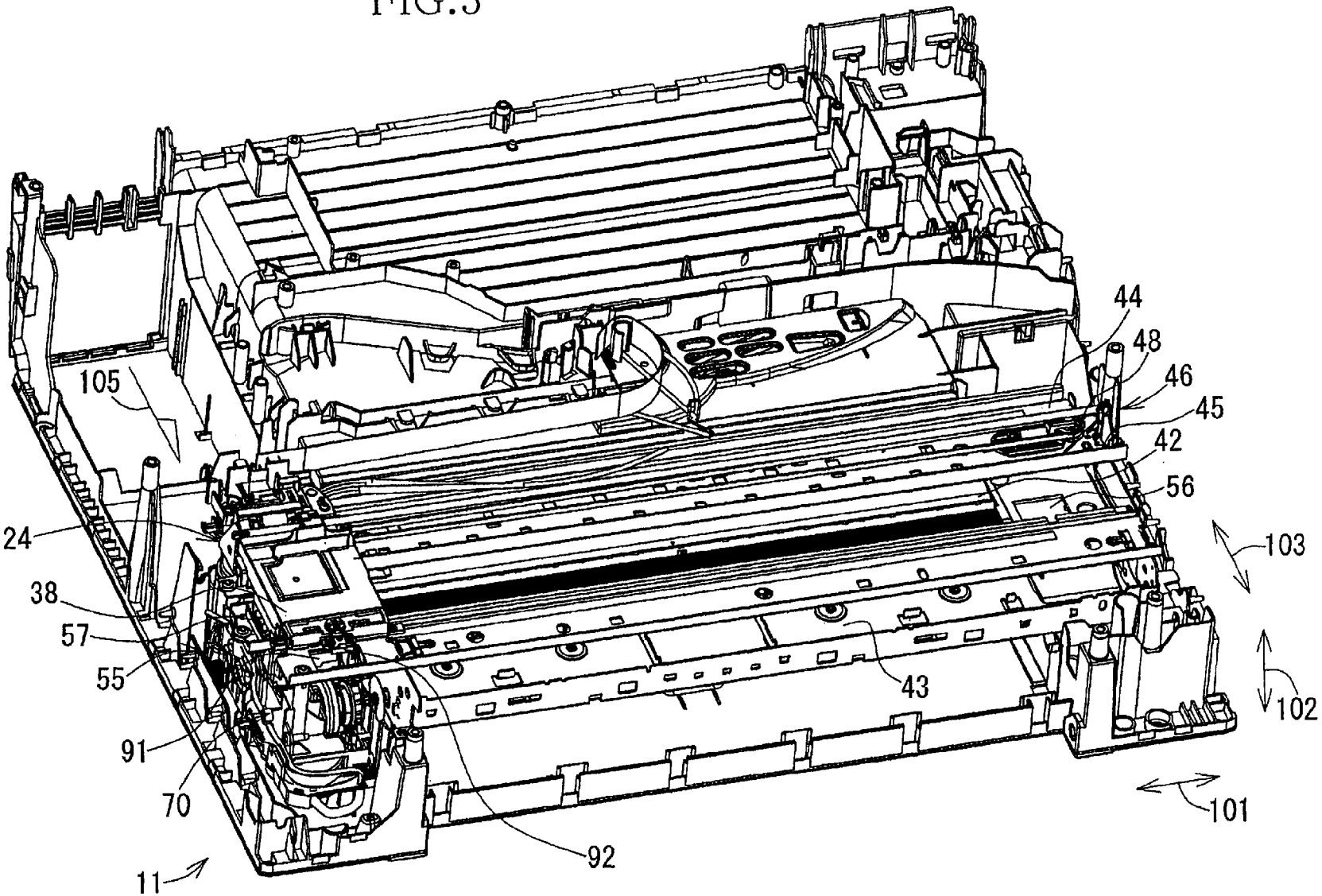
FIG. 3 is a perspective view as seen from a rear side showing an internal structure of a printer portion of the MFD.

A belt drive device (a carriage drive device) 46 is provided on the upper surface of the guide rail 44. The belt drive device 46 includes a driving pulley (not shown) and a driven pulley 48 which are provided adjacent to respective ends of the guide rail 44 in the widthwise direction of the sheet-feed path 23, and an endless annular belt 49 which is wound on the pulleys 48. The belt 49 has a plurality of teeth formed on its inner surface. In FIG. 3, the driving pulley is not shown behind the carriage 38. The driving pulley (i.e., a shaft portion thereof is driven or rotated by a carriage (CR) motor (not shown). When the driving pulley is driven, the belt 49 is driven or circulated. The belt 49 may be replaced with a different timing belt having ends to which the carriage 38 is connected.

Figure 11:
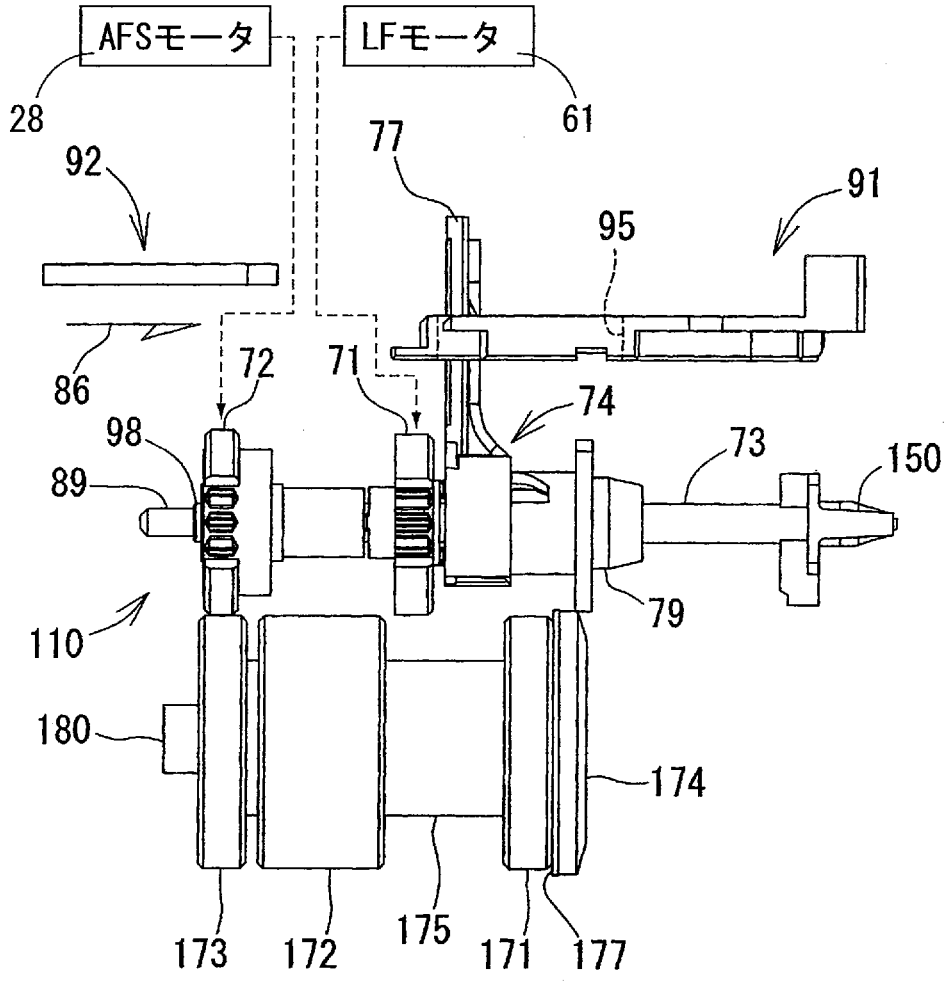
FIG. 11 is a view showing a state in which an input lever is positioned in a first power transmitting position.

As shown in FIG. 3, a lever guide 91 is provided in the guide rail 43. The lever guide 91 is fitted into a hole (not shown) that is formed in a side of the guide rail 43 on which a purging device 55 is disposed so as to be fixed to the guide rail 43. A drive switch device 70 is located below the lever guide 91. The lever guide 91 has a generally flat structure and has a guide hole 96 inside thereof. As described later, an input portion 77 of an input lever 74 is inserted into the guide hole 95 and extends upward out of the guide rail 43. When an external force is not applied to the input portion 77, as shown in FIG. 11, the input portion 77 that is inserted into the guide hole 95 is maintained at a first power (drive) transmitting position corresponding to an inner end portion of the guide hole 95 that is located nearer to an inner side of the MFD 10.

The carriage 38 is connected at a bottom thereof to the belt 49. Therefore, when the belt 49 is driven or circulated by the CR motor, the carriage 38 is reciprocated on the two guide rails 43, 44 while being guided by the edge portion 45. That is, the recording head 39 carried by the carriage 38 is moved in the main scanning direction or in the widthwise direction of the sheet-feed path 23 while being supported by the two guide rails 43, 44.

As shown in FIG. 3, in an upstream end of the carriage 38 in the sheet feed direction, there is disposed a guide piece 92 that extends horizontally toward the upstream end in the sheet feed direction. The guide piece 92 is reciprocated along with the carriage 38. As the carriage 38 is moved, the guide piece 92 is come into contact with the input portion 77 (shown in FIG. 5) that extends upward above the guide rail 43 through the guide hole 95 (shown in FIG. 11). Therefore, a position of the input lever 74 can be changed. Controlling a reciprocating movement of the carriage 38 can arbitrarily and selectively change the position of the input lever 74. When the input lever 74 is selectively moved to a predetermined position (a first drive position or a second drive position, as mentioned later), a first switching gear 71 and a second switching gear 72 are positioned at respective positions corresponding to the position of the input lever 74.

Below the sheet feed path 23, a platen 42 is disposed so as to be opposed to the recording head 39. The platen 42 extends over an intermediate portion of the range of reciprocating movement of the carriage 38, i.e., a portion of the range where the recording sheets pass. A width of the platen 42 as measured in the widthwise direction of the sheet-feed path 23 is larger than a maximum width of all sorts of the recording sheets that can be used in the printer portion 11. A constant (fixed) distance is maintained between the recording sheets that are supported by an upper surface of the platen 42 and the recording head 39. The recording head 39 selectively ejects droplets of inks toward each recording sheet being fed onto the platen 42.

As shown in FIG. 3, there is provided the purging device 55 on one of opposite sides in a widthwise direction of the platen 42 (in the direction indicated by the arrow 101), and a waste-ink tray 56 on the other side in the widthwise direction. In FIG. 3, the purging device 55 is located on a left-hand side, and the waste-ink tray 56 on a right-hand side. The waste-ink tray 56 is for performing a flushing operation in which the waste-ink tray 56 receives a waste-ink forcedly ejected by the recording head 39. The waste-ink tray 56 accommodates a felt as an ink-absorbing material that absorbs and retains the waste ink forcedly ejected by the recording head 39.

Figure 4:
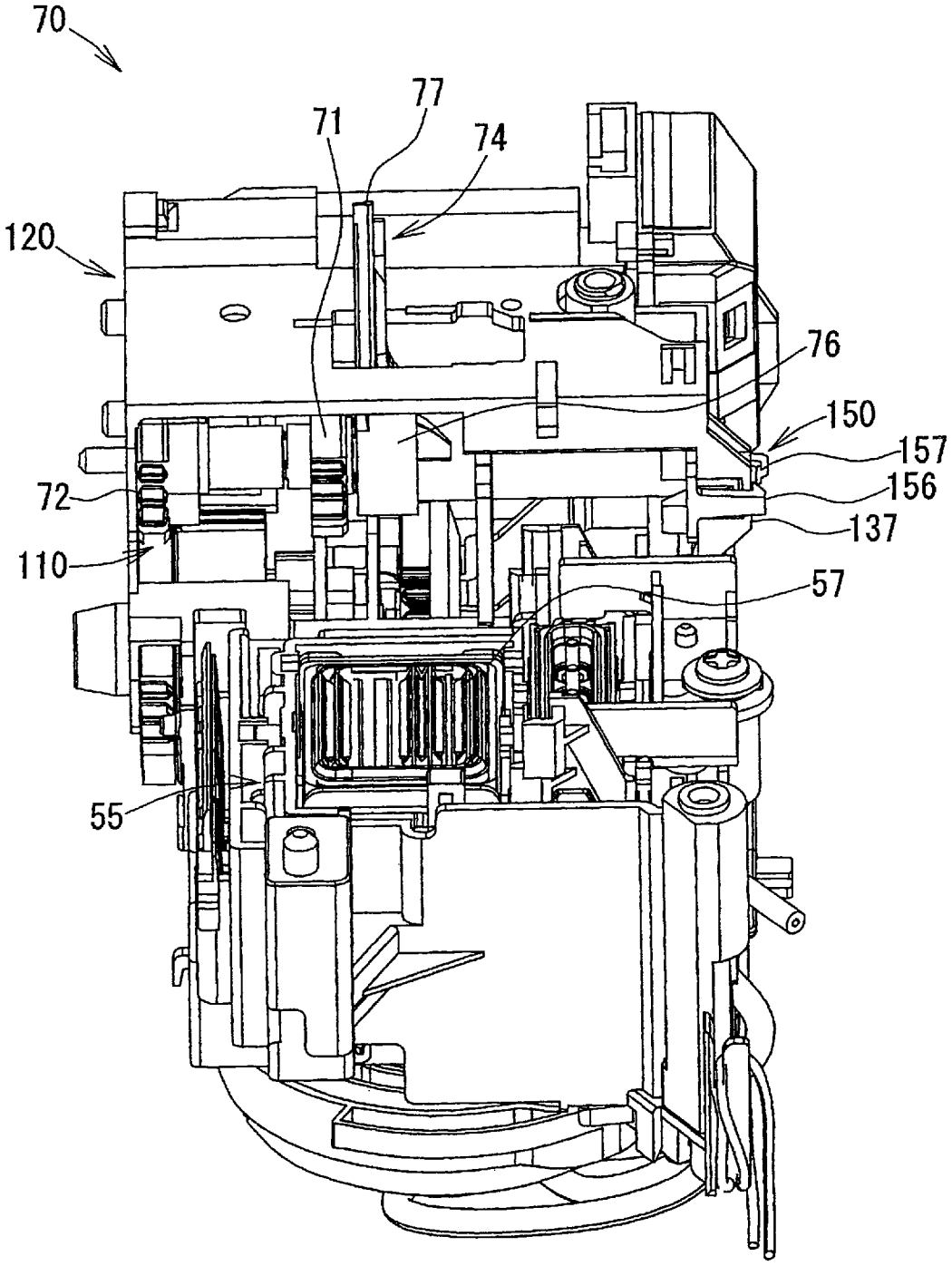
FIG. 4 is a perspective view as seen in a direction indicated by an arrow 105 in FIG. 3 showing a structure of a purging device of the MFD and components around the purging device.

The purging device 39 performs a purging operation to suck and remove foreign matters and air bubbles from nozzles of the recording head 39. As shown in FIG. 4, the purging device 55 includes a cap 57 that covers the nozzles of the recording head 39 and an exhaust opening of the recording head 39. The cap 57 is moved up and down by a conventionally known lifting device or a moving device such that the cap 57 is moved toward and away from the recording head 39. The purging device 56 also includes a pumping device, which is omitted in FIG. 4. The pumping device is connected to the cap 57. When the pumping device is operated such that an inner space defined by the cap 57 is evacuated to a negative pressure. When the pumping device is operated in a state in which the cap 57 is opposed to the recording head 39 and covers the nozzles and the exhaust opening of the recording head 39, the air bubbles and the foreign matters are sucked and removed from the recording head 39. A drive force of the LF motor 61 is transmitted to operate the pumping device of the purging device 65, while a drive force of the ASF motor 28 is transmitted to operate the lifting device of the purging device 55. That is, the pumping device and the lifting device correspond to respective one of the plurality of driven portions in the present invention. The purging device 55 and the waste-ink tray 56 can perform maintenance operations to suck and remove different color inks and the air bubbles from the recording head 39 and to prevent drying of the inks in the recording head 39.

Hereinafter, the drive switch device 70 will be described. The drive switch device 70 is an embodiment of the assembly in the present invention, and switches a power transmission from the ASF motor 28 and the LF motor 61 to the sheet-feed roller 25 and the purging device 55. The drive switch device 70 is located on a right-hand side (a left-hand side in FIG. 3) of the frame including the guide rails 44, 45, and transmits two systems of drive forces independently outputted from two motors (the LF motor 61 and the ASF motor 28) alternatively to respective driven portions.

Figure 5:
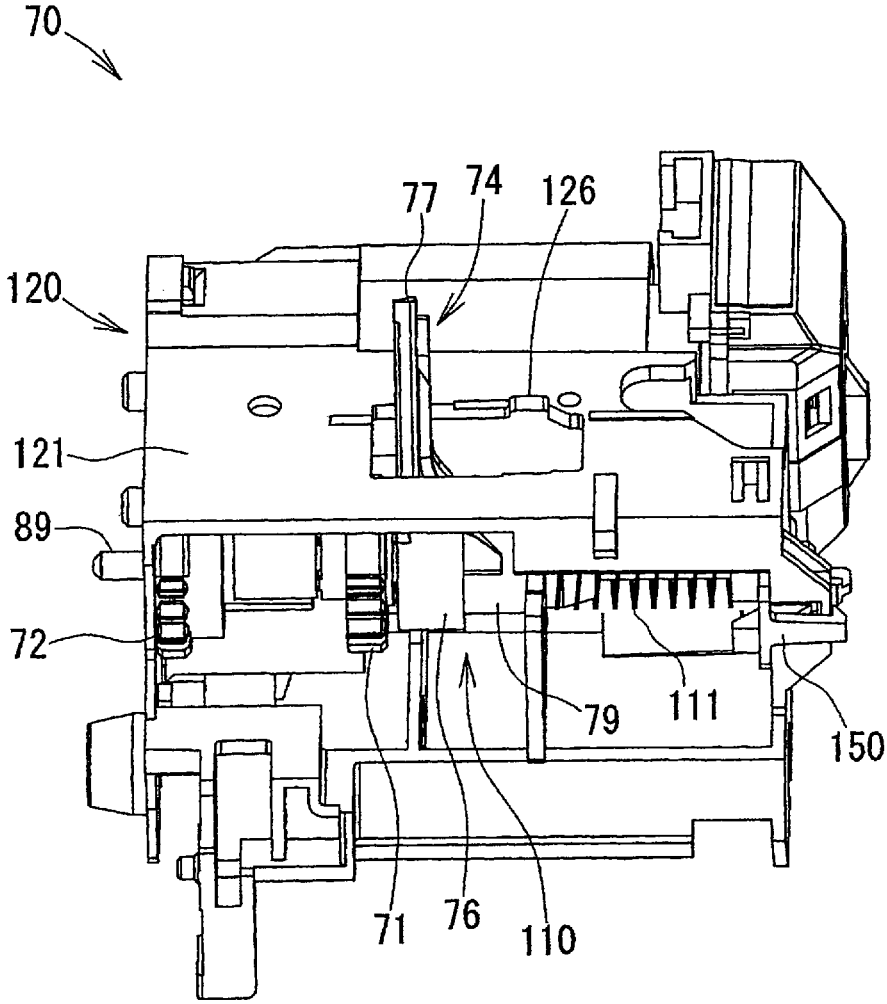
FIG. 5 is a perspective view of a structure of a drive switch device of the MFD.
Figure 6:
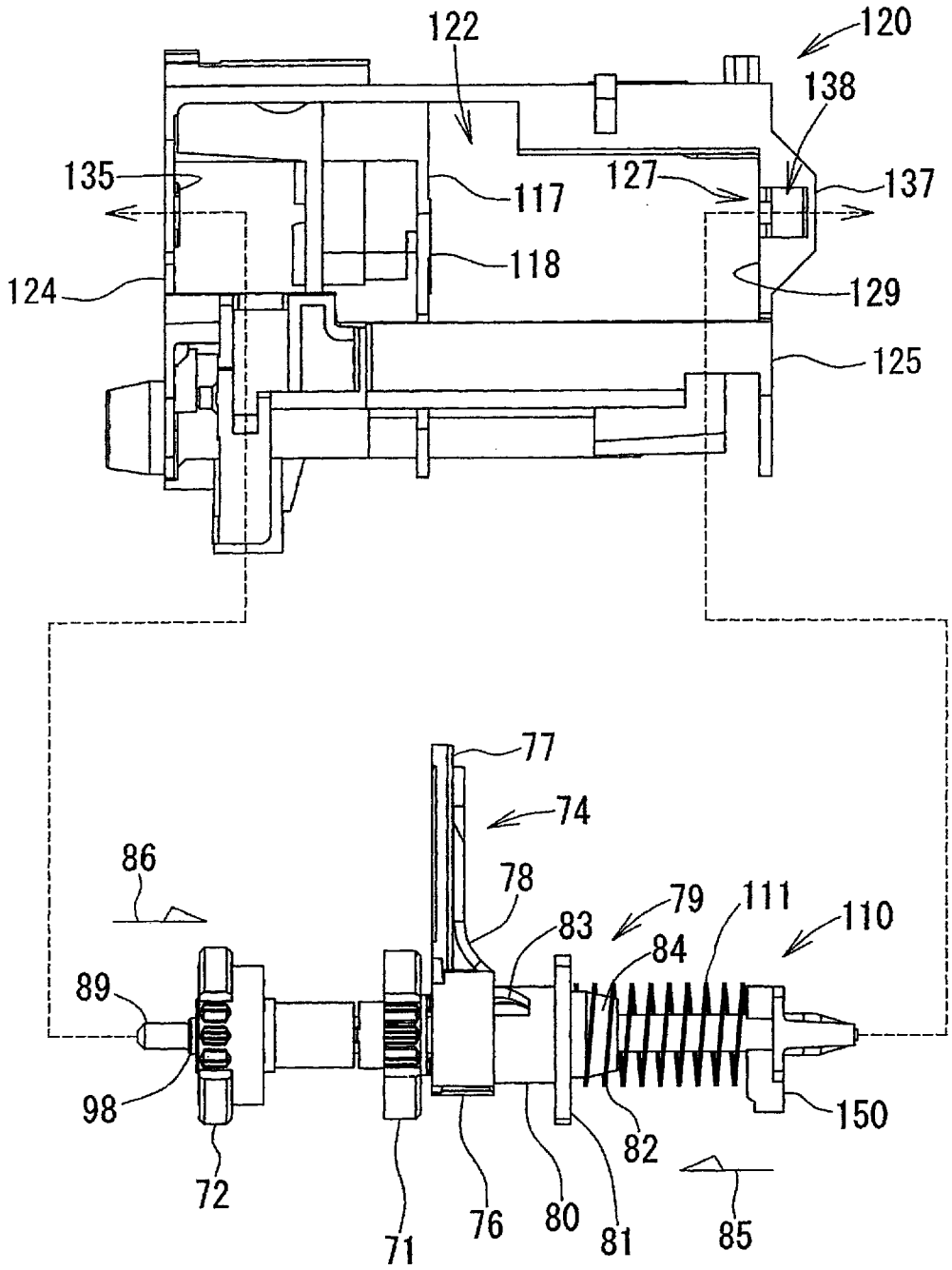
FIG. 6 is an exploded view of the drive switch device, on an upper row thereof showing a front view of a support frame, and on a lower row thereof showing a front view of a gear unit.

As shown in FIGS. 5 and 6, the drive switch device 70 includes a gear unit 110 which has a first switching gear 71 as the first switching gear in the present invention and a second switching gear 72 as the second switching gear in the present invention, and a support frame 120 as the frame in the present invention. The gear unit 110 includes the first switching gear 71, the second switching gear 72, and a support shaft 73 as the support shaft in the present invention which are supported by the support frame 120 and supports the first switching gear 71 and the second switching gear 72 rotatably and slidably in an axial direction of the support shaft 73. In the present embodiment, the support frame 120 supports the gear unit 110 and the ASF motor 28. Instead of the present embodiment, however, for example, the support frame 120 may support only the gear unit 110.

A drive force of the LF motor 61 is inputted to one end (a right-hand end in FIG. 3) of the feed roller 60. In the other end (a left-hand end in FIG. 3) of the feed roller 60, there is disposed a first drive gear (not shown) that is rotatable about the same rotation axis as the feed roller 60 and integrally with the feed roller 60. The first drive gear meshes with the first switching gear 71 of the drive switch device 70. Therefore, the first switching gear 71 is driven and rotated based on the drive force of the LF motor 61. The LF motor 61 corresponds to the first drive source in the present invention. Since a thickness of the first drive gear is larger than a range of slide of the first switching gear 71, the first switching gear 71 and the first drive gear are always meshed with each other within the range of slide of the first switching gear 71. An axis of the first switching gear 71 is in parallel with an axis of the first drive gear, and the first switching gear 71 is movable parallel to the first drive gear. A thickness of the first drive gear in an axial direction thereof corresponds to a range of movement of the first switching gear 71, so that meshing of the first drive gear and the first switching gear 71 is maintained within the range of movement of the first switching gear 71.

Figure 9A:
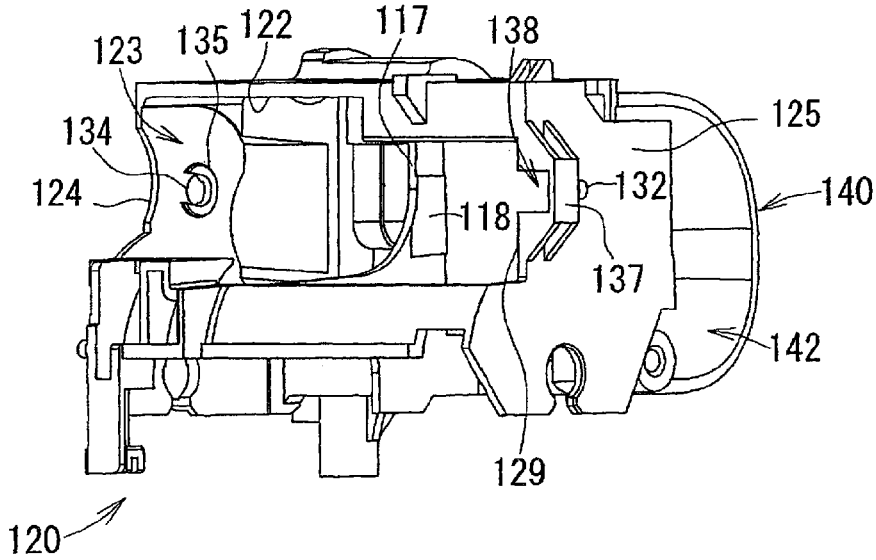
FIG. 9 is a perspective view of a structure of a support frame, especially FIGS. 9A through 9D showing respective views that are rotated in order from a front view in FIG. 6 by a predetermined angle in a horizontal direction.
Figure 9B:
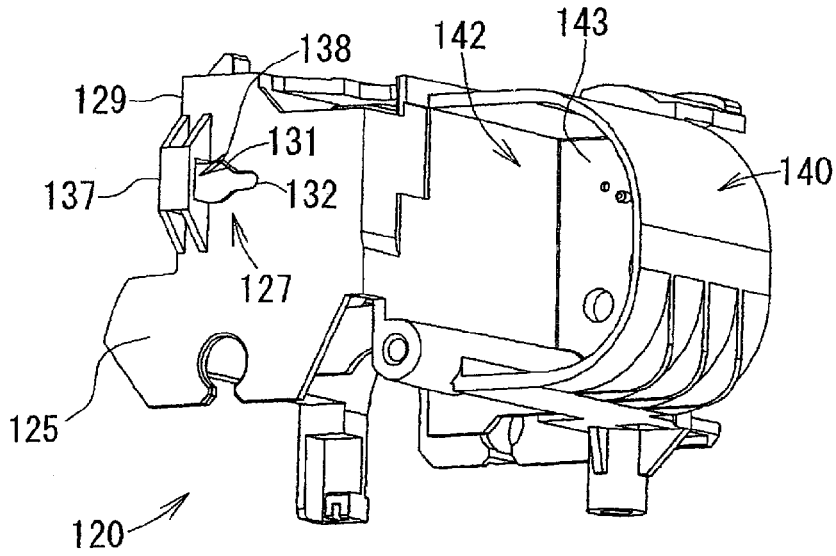
Figure 9C:
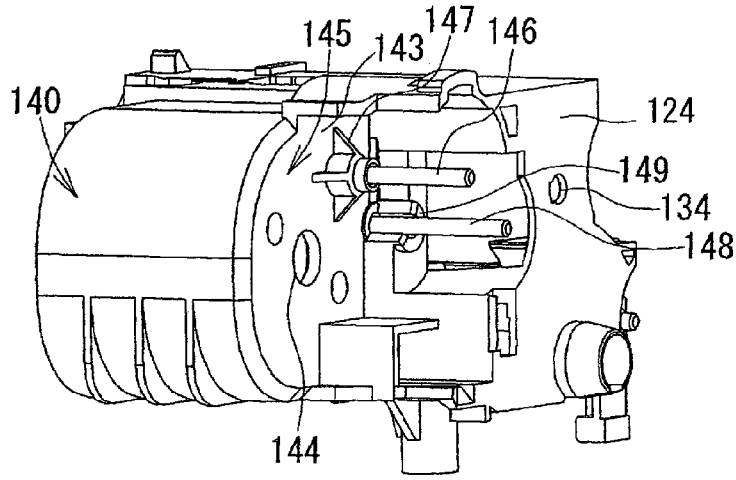
Figure 9D:
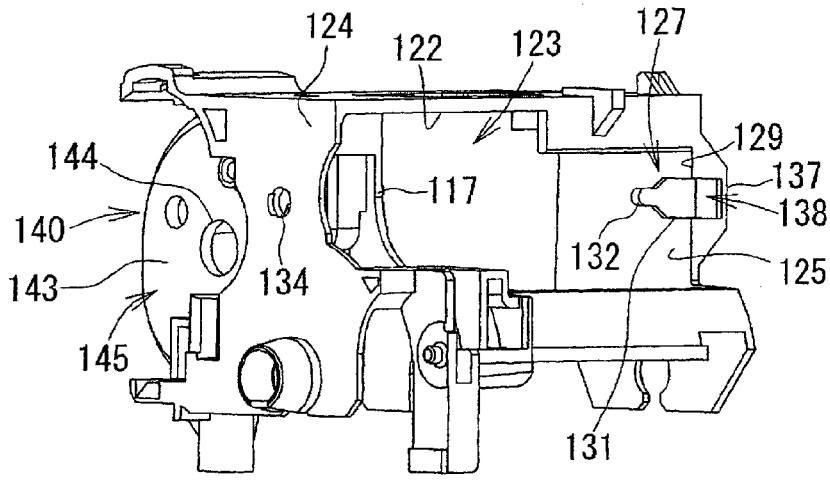

The ASF motor 28 is attached to a motor supporting portion 140, as shown in FIG. 9C. The motor supporting portion 140 will be described later. A drive force of the ASF motor 28 is transmitted from an output shaft of the ASF motor 28 to the second switching gear 72 via a second drive gear (not shown). Therefore, the second switching gear 72 is driven and rotated based on the drive force of the ASF motor 28. The ASF motor 28 corresponds to the second drive source in the present invention. Since a thickness of the second drive gear is larger than a range of slide of the second switching gear 72, the second switching gear 72 and the second drive gear are always meshed with each other within the range of slide of the second switching gear 72. An axis of the second switching gear 72 is in parallel with an axis of the second drive gear, and the second switching gear 72 is slidable parallel to the second drive gear. A thickness of the second drive gear in an axial direction thereof corresponds to a range of movement of the second switching gear 72, so that meshing of the second drive gear and the second switching gear 72 is maintained within the range of movement of the second switching gear 72.

Figure 7:
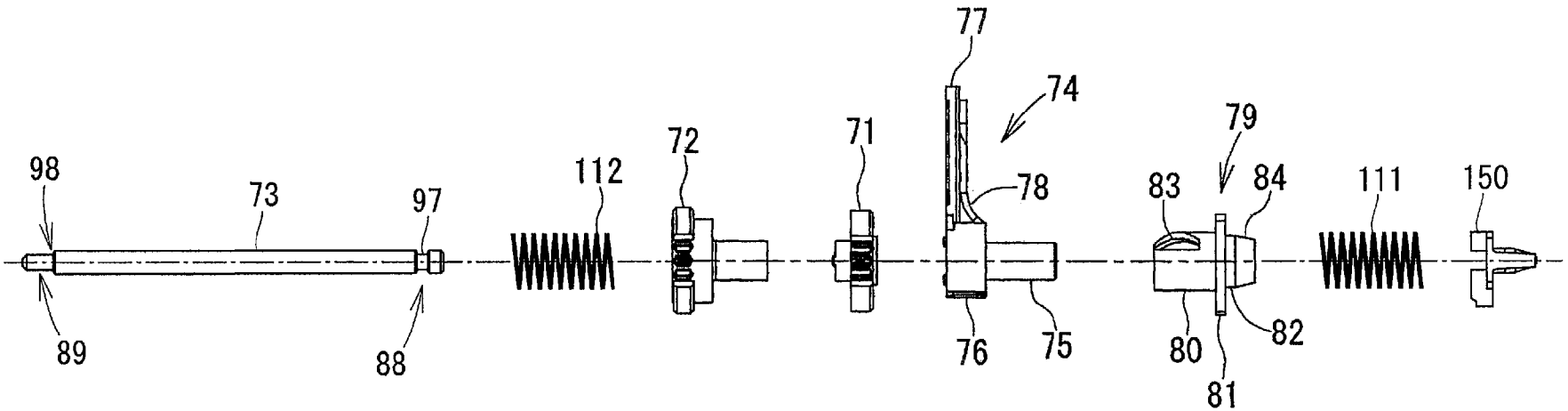
FIG. 7 is an exploded view of the gear unit.

As shown in FIGS. 6 and 7, the gear unit 110 includes, in addition to the first switching gear 71 and the second switching gear 72, a first coil spring 111 (an embodiment of the elastic member in the present invention), a second coil spring 112 (another embodiment of the elastic member in the present invention), the input lever 74, a spring retainer 79, and a stopper 160 (an embodiment of the engaging member in the present invention) that are supported by the support shaft 73 slidably in the axial direction thereof.

As shown in FIG. 7, the support shaft 73 has a rod-shaped structure. The support shaft 73 is horizontally supported by the support frame 120. An engaging groove 97 is formed in an end portion 88 of the support shaft 73 (corresponding to the other end portion of the support shaft in the present invention) that is located on an outer side of the MFD 10 or a right-hand side in FIG. 5. The engaging groove 97 is formed in an outer circumferential surface of the support shaft 73. A width of the engaging groove 97 is determined such that a second cutout portion 132 formed in a second side wall 125 mentioned later and the engaging groove 97 are engageable with each other. Further, a shoulder 98 is formed in the other end portion 89 of the support shaft 73 (corresponding to one of opposite end portions of the support shaft) that is located on an inner side of the MFD 10 or a left-hand side in FIG. 5. The shoulder can be formed by cutting work of the outer circumferential of the other end portion 89 in a circumferential direction. The engaging groove 97 and the shoulder 98 are used for supporting of the support shaft 73 by the support frame 120. A support mechanism by which the support shaft 73 is supported will be described later.

The first switching gear 71 is located on the outer side of the MFD 10, and the second switching gear 72 is located on the inner side thereof The axial direction of the support shaft 73 (a right and left direction in FIG. 5) is identical with a direction of the reciprocating movement of the carriage 38 or the main scanning direction as indicated by the arrow 101 in FIG. 1. When the first switching gear 71 and the second switching gear 72 slide on the support shaft 73, the first switching gear 71 and the second switching gear 72 selectively mesh with respective ones of a first transmission gear 171, a second transmission gear 172, and a third transmission gear 173 (one embodiment of the plurality of transmission gears in the present embodiment) as mentioned later.

The input lever 74 is located on an outer side in the main scanning direction or the direction of the reciprocating movement of the carriage 38 (on a right-hand side in FIG. 5) relative to the first switching gear 71. The input lever 74 and the lever guide 91 constitute the switching member in the present invention.

As shown in FIG. 6, the input lever 74 includes; a cylindrical portion 76 which is put on and supported by the support shaft 73; a guide portion 75 (shown in FIG. 7) which extends in the axial direction of the cylindrical portion 76 (the support shaft 73) from the cylindrical portion 76 and has a cylindrical shape and whose outside diameter is smaller than that of the cylindrical portion 76; and the input portion 77 which protrudes from the cylindrical portion 76 in a diametrical direction of the cylindrical portion 76. The cylindrical portion 76 and the guide portion 75 are fitted on and supported by the support shaft and are freely slidable and rotatable. In other words, the input portion 77 is slidable in the axial direction of the support shaft 73 and rotatable about a rotation axis of the support shaft 73. In the vicinity of a base or a bottom end of the input portion 77, there is provided a rib 78 that extends in the axial direction of the cylindrical portion 76.

The spring retainer 79 includes; a cylindrical portion 80 which can be fitted on the guide portion 75 of the input lever 74; a flange 81 which is disposed on one of opposite ends of the cylindrical portion 80 that is located on the outer side of the MFD 10 (a right-hand side in FIG. 5); a cylindrical portion 82 which extends from the flange 81 toward the outer side of the MFD 10. The cylindrical portion 80 is fitted on the guide portion 75 of the input lever 74 and is freely slidable and rotatable. In the other end of the cylindrical portion 80 that is close to the input lever 74, there is formed a guide surface 83 that extends from an end surface of the other end of the cylindrical portion 80 in a spiral manner about an axis of the cylindrical portion 80. The guide surface 83 is formed in such a manner that a part of outer circumference of the cylindrical portion 80 is cut spirally. The guide surface 83 can be come into contact with a rib (not shown) that is formed in an inner surface of the cylindrical portion 76 of the input lever 74.

An outside diameter of the cylindrical portion 80 is smaller than that of the cylindrical portion 76 of the input lever 74. Accordingly, a limit of inserting of the cylindrical portion 80 relative to the guide portion 75 is determined by the cylindrical portion 76. An end portion 84 of the cylindrical portion 82 that is opposite to the flange 81 has a tapered outer surface. Due to the end portion 84, the first coil spring 111 can be easily inserted to the cylindrical portion 82 and can be surely seated on or supported by the cylindrical portion 82 and the flange 81.

In a state in which the gear unit 110 is attached to the support frame 120, the first coil spring 111 and the second coil spring 112 (shown in FIG. 7) are compressed. The first coil spring 111 and the second coil spring 112 are elastic in the axial direction of the support shaft 73. The spring retainer 79 is biased by the first coil spring 111 toward the input lever 74 or in a direction indicated by an arrow 85 in FIG. 6. The second switching gear 72 is biased by the second coil spring 112 (shown in FIG. 7) toward the input lever 74 or in a direction indicated by an arrow 86 in FIG. 6. The first switching gear 71 is also biased by the second coil spring 112 toward the input lever 74 via the second switching gear 72. In other words, the second switching gear 72 and the spring retainer 79 are respectively biased by the first, the second coil springs 111, 112 in opposing directions or in a direction in which the spring retainer 79 and the second switching gear 72 move toward each other via the first switching gear 71 and the input lever 74.

In an outermost side of the support shaft 73 or a right-hand side in FIG. 5, a stopper 150 is disposed. The stopper 150 is connected to the support frame 120 in a state in which the stopper 150 is inserted into the support shaft 73. When the stopper 150 is connected to the support frame 120, the end portion 88 of the support shaft 73 that is located on the outer side of the MFD 10 is fixed to the support frame 120. The stopper 150 also functions as a spring retainer that supports one end of the first coil spring 111. In a state in which the gear unit 110 is attached to the support frame 120, the stopper 150 is biased by the first coil spring 111. A detailed description of the stopper 150 and a connecting (engaging) mechanism will be described later.

In the above-described gear unit 110, the second coil spring 112, the second switching gear 72, the first switching gear 71, the input lever 74, the spring retainer 79, the first coil spring 111 and the stopper 150 are come into contact with each other in this order and are integrally arranged, and then are inserted into the support shaft 73. A biasing force of the first coil spring 111 (a biasing force in the direction indicated by the arrow 85 in FIG. 6) that biases the spring retainer 79 is larger than a biasing force of the second coil spring 112 (a biasing force of in the direction indicated by the arrow 86) that biases the second switching gear 72. Therefore, when an external force is not applied, the second switching gear 72, the first switching gear 71, the input lever 74 and the spring retainer 79 are biased by the first coil spring 111 and slid on the support shaft 73 in the direction indicated by the arrow 85 so as to be positioned on a side close to the end portion 89 of the support shaft 73 that is located on the inner side of the MFD 10 (the left-hand side in FIG. 5). In this state, the input portion 77 of the input lever 74 is positioned at the first power transmitting position, as shown in FIG. 11. In a state in which the first switching gear 71 and the second switching gear 72 that are held in contact with each other by the first, second coil springs 111, 112 are disposed integrally, i.e., a positional relation between the first, second switching gears 71, 72 becomes fixed, the first, second switching gears 71, 72 are rotatable independently.

Figures 8A, 8B, 8C, 8D, 8E, 8F, 8G:
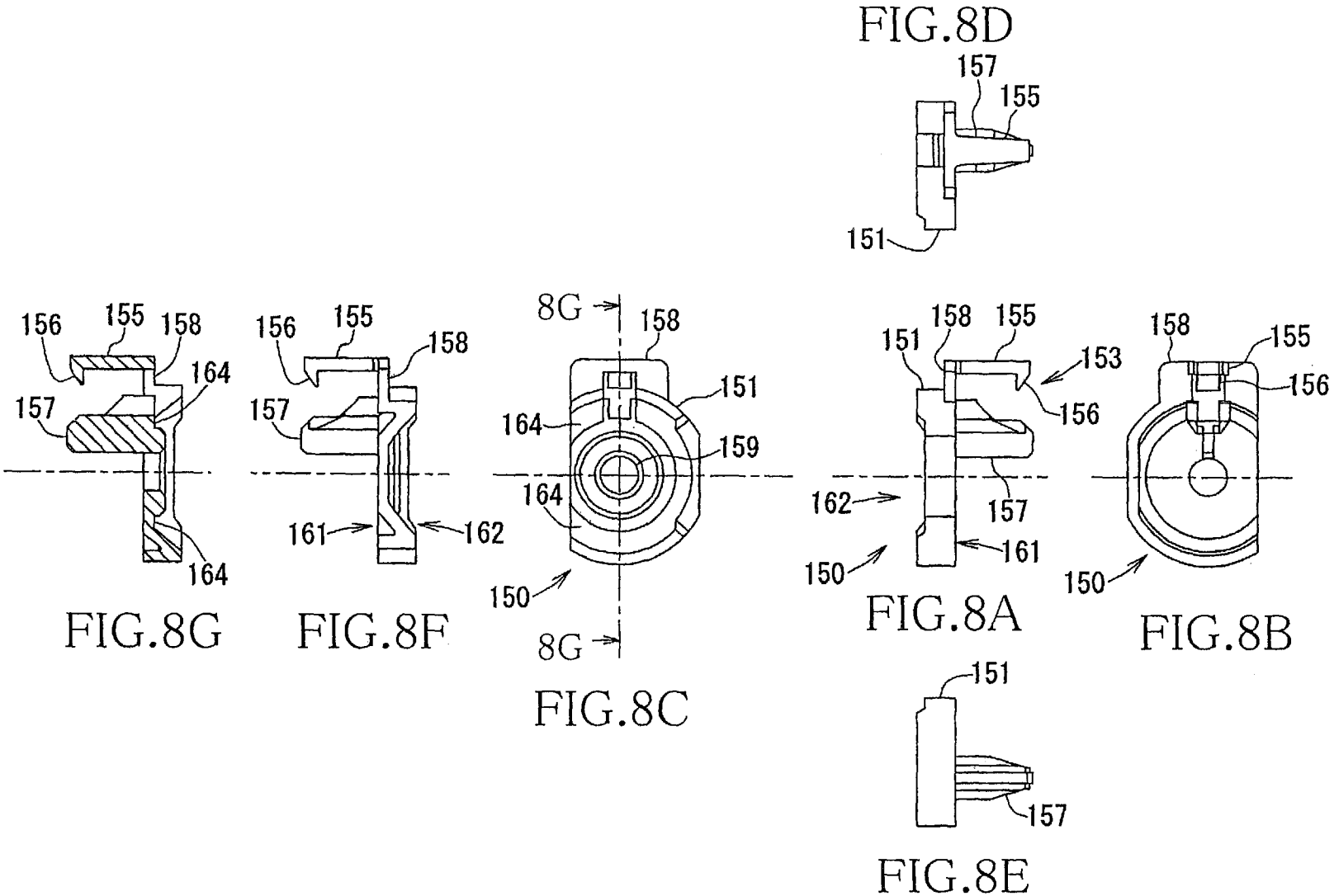
FIGS. 8A through 8F are views of respective structures of a stopper as seen in six directions.
FIG. 8G is a cross-sectional view taken along line 8G-8G in FIG. 8A.

As shown in FIG. 8, the stopper 150 includes a base portion 151 and a holding portion 153 as one embodiment of the handle portion in the present embodiment. In a middle of the base portion 151, an axial hole 159 is formed. In a back surface 162 of the base portion 151, a groove 164 is formed for supporting the first coil spring 111. The groove 164 has a circular shape such that a part of a concentric circle centering on the axial hole 159 is chipped off. One end of the first coil spring 111 is inserted into and accommodated in the groove 164. Accordingly, the first coil spring 111 is certainly seated on the back surface 162 of the stopper 150. In the present embodiment, as shown in FIG. 8C, the base portion 151 has an unsymmetrical shape, and the base portion 151 is not limited to the present embodiment. The base portion 151 may has a bilaterally symmetric shape. In a case where the base portion 151 is formed symmetrically, the groove 164 has a generally annular shape.

The holding portion 153 has a pair of holding claws or arms 155, 157 that protrude from a front surface 161 of the base portion 151 perpendicularly or in a right-hand direction in FIG. 8A. The base portion 151 has a base 158 that protrudes from a circumferential edge (an upper edge in FIG. 8A) outwards in a diametrical direction, i.e., in a direction perpendicular to an axis of the axial hole 159 or in a direction away from the base portion 151. The holding claw 155 protrudes from the base 158 so as to be easily held by an assembler. The holding claw 157 protrudes from a portion of the base portion 151 between the axial hole 159 and the holding claw 155. In a distal end of the holding claw 155, there is disposed an engaging protrusion 156 that protrudes from a surface of the distal end of the holding claw 155 toward the holding claw 157. When a bridge portion 137 of the support frame 120 (shown in FIG. 9) as the second connecting portion is positioned between the holding claws 155, 157, the holding portion 153 (the holding claws 155, 157) nip and hold the bridge portion 137 from both sides. The holding portion 153 and the bridge portion 137 are thus connected and fixed to each other.

The support frame 120 supports the gear unit 110 and the ASF motor 28. The support frame 120 is formed by injection molding of synthetic resin. As the synthetic resin, acrylonitrile-butadiene-styrene (ABS) resin, polyacetal (POM) resin, and various kinds of resin can be used. In the present embodiment, the support frame 120 is formed of a resin having high rigidity that is called reinforced ABS resin, for example, reinforced ABS resin (ABS/PBT-20GF) in which 20% of glass fiber are mixed.

As shown in FIG. 9A, the support frame has an opening 122 which has a horizontally long shape. Inside of the opening 122, an accommodating portion 123 is formed for accommodating the gear unit 110. In the accommodating portion 123, a direction extending from the opening 122 perpendicular to the support shaft 73 is a direction of depth. The accommodating portion 123 is formed by a resin mold in the depth direction of the accommodating portion 123 as a draft direction.

The accommodating portion 123 includes a rib 117 which has a flat-plate structure and stands up from an inner surface of the accommodating portion 123. The rib 117 extends in the depth direction of the accommodating portion 123, i.e., the draft direction of the resin mold for making the accommodating portion 123. Therefore, the rib 117 has a draft. In the present embodiment, the rib 117 does not have the draft over a whole length thereof, and a part of the rib 117 is formed without the draft. More precisely, the rib 117 has a flat portion 118 consisting of a flat plane perpendicular to the support shaft 73. The flat portion 118 is located at a position of the accommodating portion 123 corresponding to a boss portion 149 (shown in FIG. 9C) as mentioned later, and functions as a portion that is pressed by a jig for assisting a press fitting when a rod 148 is press fitted into the boss portion 149. In the present embodiment, a part occupied by the flat portion 118 out of an area of the rib 117 is determined to such an extent that a drafting operation of the resin mold is not harmed.

As shown in FIGS. 9A through 9D the support frame 120 includes a first side wall 124 as the first wall and a second side wall 125 as the second wall. The first side wall 124 and the second side wall 126 are opposed to each other. Opposite ends of the opening 122 in a lengthwise direction are defined by the first side wall 124 and the second side wall 125.

In the first side wall 124, a through hole 134 as the recessed portion in the present invention is formed. The through hole 134 extends in a direction of thickness of the first side wall 124 and penetrates through the first side wall 124. The end portion 89 of the support shaft 73 can be inserted into the through hole 134. When the end portion 89 of the support shaft 73 is inserted into the through hole 134 slantwise (slantingly or in a slanting direction) or in an inclined direction, the shoulder 98 formed in the end portion 89 is come into contact with a periphery of the through hole 134, and the support shaft 73 is restricted to be inserted further. Though the through hole 134 in the present embodiment corresponds to the recessed portion in the present invention, the present invention is not limited to the present embodiment. For example, a recessed portion that is formed in an inner surface of the first side wall 124 or a boss portion which protrudes from the inner surface of the first side wall 124 and in which a hole is formed is applicable to the present invention as the recessed portion.

In the inner surface of the first side wall 124, a spring retainer 135 is disposed. The spring retainer 135 has a generally annular shape and is formed such that a part of the spring retainer 135 is cut out along a circumference of the thorough hole 134. In a state in which the gear unit 110 is attached to the support frame 120, one end of the second coil spring 112 is seated on the spring retainer 135.

A cutout 127 as one embodiment of the cutout in the present invention is formed in the second side wall 125. The cutout 127 is located at a position corresponding to the through hole 134 of the first side wall 124. The end portion 88 of the support shaft 73 can be inserted into the cutout 127. The cutout 127 has a first cutout portion 131 which is formed from one (front) side edge 129 of the second side wall 125 that is dose to the opening 122 toward a rear side of the support frame 120, and a second cutout portion 132 which is formed from a rear end portion of the first cutout portion 131 toward a further rear side of the support frame 120. The first cutout portion 131 is located adjacent to the one side edge 129. A width of the second cutout portion 132 is smaller than that of the first cutout portion 131.

The width of the first cutout portion 131 is determined to be larger enough than an outer diameter of the support shaft 73. On the other hand, the width of the second cutout portion 132 is determined to be smaller than the outer diameter of the support shaft 73 and be slightly larger than an inner diameter of the engaging groove 97. A joint portion between the first cutout portion 131 and the second cutout portion 132 is tapered. In a state in which a positional relation between the engaging groove 97 of the support shaft 73 and the cutout 127 is determined, when the end portion 88 is inserted into the cutout 127, the end portion 88 is guided by the first cutout portion 131 to move toward the second cutout portion 132. Then, the end portion 88 is inserted into the second cutout portion 132. In this state, the support shaft 73 is restricted from moving in the axial direction of the support shaft 73. A rear end portion of the second cutout portion 132 that is opposite to the first cutout portion 131 has a circular arc shape corresponding to the engaging groove 97.

A bridge portion 137 is disposed in the second side wall 125. The bridge portion 137 is located on an outer surface of the second side wall 125 that is opposite to an inner surface thereof opposed to the first side wall 124 and in the vicinity of the cutout 127. More precisely, the bridge portion 137 is disposed in an outer space of the second side wall 125 such that the bridge portion 137 bridges the first cutout portion 131. An insertion opening 138 is formed between the bridge portion 137 and the first cutout portion 131. When the end portion 88 of the support shaft 73 is inserted into the cutout 127, the end portion 88 is inserted through the insertion opening 138 toward the cutout 127.

As shown in FIG. 5, an opening 126 is formed in an upper surface 121 of the support frame 120. The opening 126 is a long hole extending in the axial direction of the support shaft 73. In a state in which the gear unit 110 is attached to the support frame 120, the input portion 77 of the input lever 74 is inserted into the opening 126 and extends through the opening 126. A width of the opening 126, i.e., the width of the opening 126 along the axial direction of the support shaft 73 is determined to be larger than a range of movement of the input lever 74. Therefore, the movement of the input lever 74 is not restricted by the opening 126.

As shown in FIGS. 9A through 9D, a motor supporting portion 140 is provided on a rear side of the support frame 120. The motor supporting portion 140 includes an accommodating portion 142 in which the ASF motor 28 is accommodated. A depth direction of the accommodating portion 142 extends in parallel with the axial direction of the support shaft 73. The accommodating portion 142 is formed by a resin mold and so on in the depth direction of the accommodating portion 142 as a draft direction. Accordingly, a bottom surface of the bottom wall 143 of the accommodating portion 142 is a flat surface perpendicular to the depth direction thereof, i.e., the axial direction of the support shaft 73. When the ASF motor 28 is accommodated in the accommodating portion 142, the output shaft of the ASF motor 28 is inserted into a hole 144 that is formed in the bottom wall 143 of the accommodating portion 142 and protrudes from a back surface or an outer surface 146 of the bottom wall 143 to a back side of the accommodating portion 142.

A rod 146 is provided to set up from the back surface 146 of the bottom wall 143. The rod 146 pivotally supports a drive gear for transmitting a drive force from the output shaft of the ASF motor 28. The rod 146 is press fitted into a boss portion 147 that is disposed in the back surface 145 so as to be fixed to the bottom wall 143. When the rod 146 is press fitted into the boss portion 147, in a state in which the bottom wall 143 is supported by the jig from an inner side of the accommodating portion 142, the rod 146 is inserted and pressed into the boss portion 147. Accordingly, the rod 146 is press fitted into the boss portion 147.

The boss portion 149 is provided in the vicinity of the boss portion 147. As shown in FIG. 9C, the boss portion 149 is located on a side of the accommodating portion 123 apart from the bottom wall 143 and provided on a surface aligned with the back surface 145 of the bottom wall 143. The boss portion 149 extends in the axial direction of the support shaft 73 from a base portion in the form of the flat portion 118 of the rib 117 that is formed in the accommodating portion 123. The rod 148 is press fitted into the boss portion 147. The rod 148 pivotally supports a tandem gear or a relay gear for transmitting the drive force transmitted from the drive gear supported by the rod 146 to the second switching gear 72. When the rod 148 is press fitted into the boss portion 149, in a state in which the flat portion 118 is pressed or supported by the jig from the inner side of the accommodating portion 123, the rod 148 is inserted and pressed into the boss portion 149. The rod 148 is thus press fitted into the boss portion 149.

Hereinafter, there will be described a method by which the gear unit 110 is attached to the support frame 120, that is, a method of assembling of the drive switch device 70 with reference to FIG. 10.

First, in a state in which the first side wall 124 is located on a lower side while the second side wall 125 is on a upper side, the support frame 120 is set up on a predetermined assembly base. Then, when the end portion 89 of the support shaft 73 is inserted from the opening 122 into the through hole 134 in the slanting direction, the shoulder 98 formed in the end portion 89 is come into contact with the periphery of the through hole 134, and the support shaft 73 is restricted to be inserted further. As shown in FIG. 10 (1), the support shaft 73 in a slanted state is supported by the periphery of the through hole 134.

Figure 10:
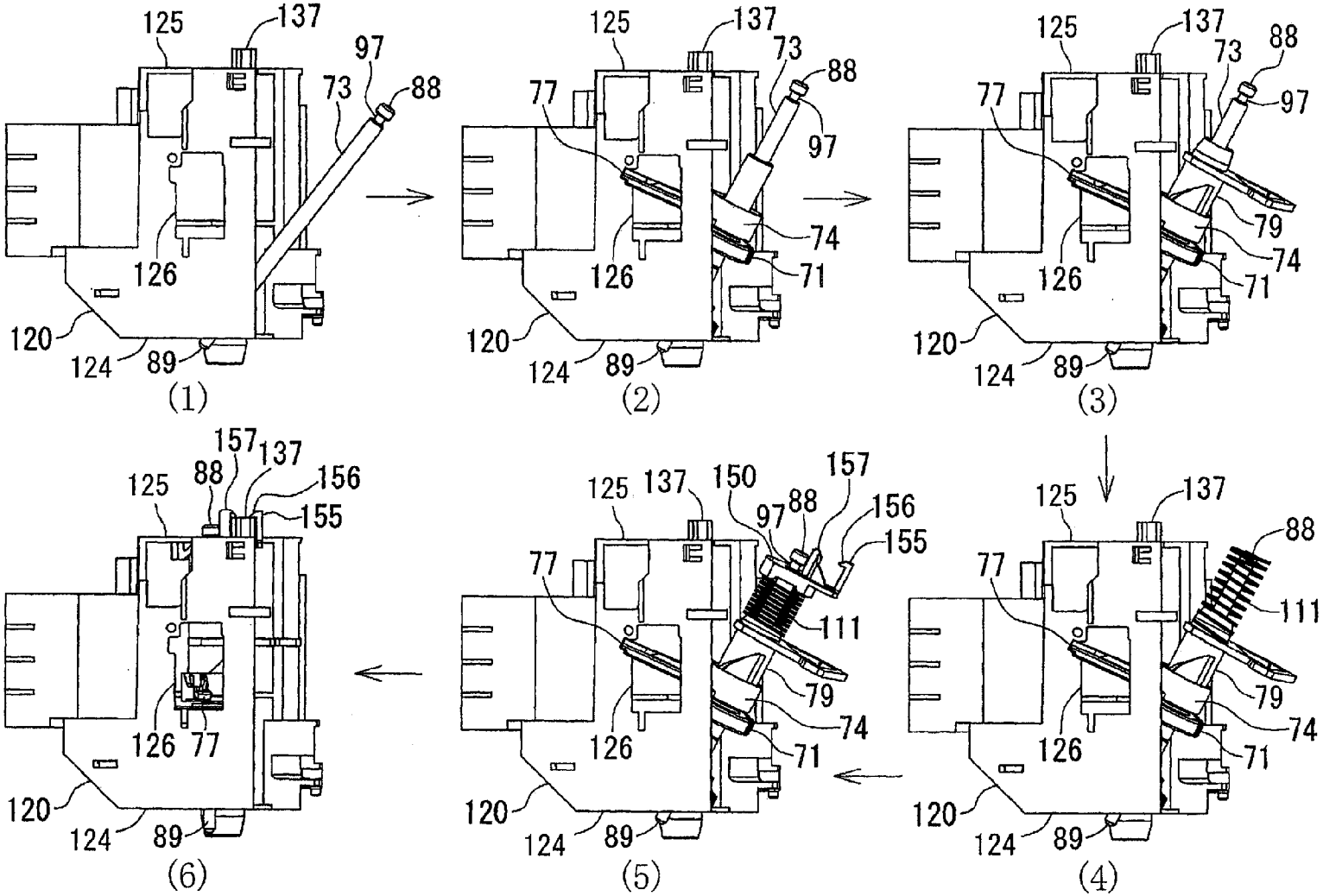
FIG. 10 is a view for describing a method by which the gear unit is attached to the support frame.

Next, as shown in FIGS. 10 (2) and 10 (3), the second coil spring 112, the second switching gear 72, the first switching gear 71, the input lever 74, and the spring retainer 79 are inserted in this order into the support shaft 73 from the end portion 88 thereof. When the input lever 74 is inserted into the support shaft 73, the input lever 74 is pressed downward against an elastic force of the second coil spring 112 such that the second coil spring 112 is compressed. Then, as shown in FIG. 10 (2), in a state in which the second coil spring 112 is compressed, the input portion 77 of the input lever 74 is inserted into the opening 126. Therefore, even when the assembler releases the input lever 74, the second coil spring 112 is maintained in a compressed state.

As shown in FIGS. 10 (4) and 10 (5), next to the spring retainer 79, the first coil spring Ill is inserted into the support shaft 73, and then, the stopper 150 is inserted into the support shaft 73. When the stopper 150 is inserted into the support shaft 73, the holding claw 155 functions as a handle portion. In other words, the assembler holds the holding claw 155 and inserts the stopper 150 into the support shaft 73. The stopper 150 is inserted into the support shaft 73 while the assembler presses the stopper 150 downward against an elastic force of the first coil spring 111 such that the first coil spring 111 is compressed.

Then, the end portion 88 of the support shaft 73 is guided to move toward the bridge portion 137 while the assembler holds the holding claw 155. Accordingly, the end portion 88 is inserted through the insertion opening 138 and to the cutout 127. In a state in which the engaging groove 97 of the support shaft 73 and the cutout 127 are relatively positioned at each other, the end portion 88 is inserted into the cutout 127. The end portion 88 is guided to move from the first cutout portion 131 to the second cutout portion 132 by the tapered joint portion, and the engaging groove 97 is inserted into the second cutout portion 132. In this state, the support shaft 73 is restrained from moving in the axial direction thereof. In a state in which the engaging groove 97 is inserted into the second cutout portion 132, the holding claw 157 is inserted into the first cutout portion 131.

Then, when the assembler holds the holding claw 155 and lifts up the stopper 150, the bridge portion 137 is inserted between the two holding claws 155, 157. In this state, as shown in FIG. 10 (6), the engaging protrusion 157 of the holding claw 165 is engaged with the bridge portion 137 so that the stopper 150 and the bridge portion 137 are connected and fixed to each other. Accordingly, the support shaft. 73 is restrained from moving in a direction in which the cutout 127 extends. When the gear unit 110 is thus attached to the support frame 120, assembling of the drive switch device 70 is completed.

Figure 12:
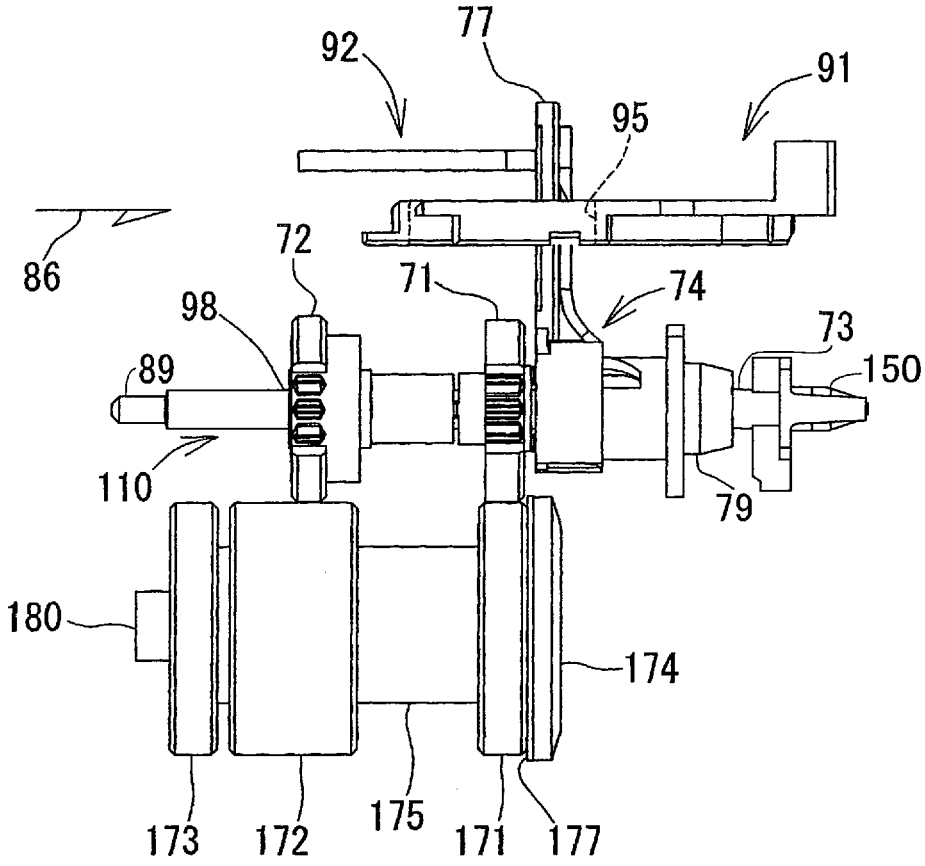
FIG. 12 is a view showing a state in which the input lever is positioned in a second power transmitting position.

As shown in FIGS. 11 and 12, below the first switching gear 71 and the second switching gear 72, the first transmission gear 171, the second transmission gear 172 and the third transmission gear 173 are supported in parallel by a support shaft 180 that extends in parallel with the support shaft 73. The first transmission gear 171 can be meshed with and detached from the first switching gear 71. A respective one of the second transmission gear 172 and the third transmission gear 173 can be meshed with and detached from the second switching gear 72. Each of the first, second, third transmission gears 171, 172, 173 has a different thickness while the first, second, third transmission gears 171, 172, 173 have the same outer diameter. Only the first transmission gear 171 has a bevel gear 174. The first, second, third transmission gears 171, 172, 173 are located in this order from the outer side of the MET 10 (on a right-hand side in FIG. 11) on the support shaft 180. The first transmission gear 171 and the second transmission gear 172 are spaced from each other by a spacer 175.

In the first transmission gear 171, the bevel gear 174 is disposed on the outer side of the MFD 10. An outer diameter of the bevel gear 174 is larger than that of the first transmission gear 171 such that a control surface 177 is formed therebetween. The control surface 177 protrudes outward in a direction of diameter of the first transmission gear 171 or in a direction away from the transmission gear 171. When the first switching gear 71 is come into contact with the control surface 177, the first switching gear 71 is prevented from sliding in a direction indicated by the arrow 86 further from a position at which the first switching gear 71 and the first transmission gear 171 are meshed with each other. Therefore, meshing of the first switching gear 71 and the first transmission gear 171 is maintained, and the input lever 74 and the spring retainer 79 are separated from the first switching gear 71.

The first, second, third transmission gears 171, 172, 173 are for transmitting a drive force to respective driven portions. More precisely, the first transmission gear 171 performs a power transmission along with the bevel gear 174 disposed on one end of the first transmission gear 171 to the pumping device of the purging device 55 and so on. The second transmission gear 172 performs a power transmission to the lifting device of the purging device 55 for lifting up and down of the cap 57. The third transmission gear 178 performs a power transmission to the sheet-feed roller 25. As shown in FIG. 11, when the input portion 77 of the input lever 74 is positioned in the first power transmitting position, the second switching gear 72 meshes with the third transmission gear 173 and the first switching gear 71 meshes with no gears. As shown in FIG. 12, when the input portion 77 of the input lever 74 is positioned in the second power transmitting position, the second switching gear 72 meshes with the second transmission gear 172 and the first switching gear 71 meshes with the first transmission gear 171. Each of the first, second, third transmission gears 171, 172, 173 is determined to transmit a drive force to corresponding one of the plurality of driven portions. As a power transmission mechanism (device) by which a power is transmitted from the first, second, third transmission gears 171, 172, 173 to the plurality of driven portions, there can be adopted a power transmission mechanism that includes gear lines or belts and is known in the art. The power transmission mechanism is not directly related to the present invention, so that a detailed description thereof is omitted.

In the present embodiment, the drive switch device 70 includes the support frame 120 and the gear unit 110. When the gear unit 110 is attached to the support frame 120, the assembler only holds the holding claw 155 of the stopper 150 as the handle portion so as to easily perform a series of operations including an operation (a process) in which the first coil spring 111 is compressed, another operation in which the second cutout portion 132 of the cutout 127 and the engaging groove 97 are engaged with each other in a state in which the compressed state of the first coil spring 111 is maintained, another operation in which the holding portion 163 and the bridge portion 137 are connected to each other. Further, unlike a conventional method of assembling, the gear unit 119 can be attached to the support frame 120 without the support frame 120 being deformed (bent), so that a rigid body can be used as the support frame 120. Therefore, positional accuracy of the center of the support shaft 73 relative to the rigid support frame 120 is improved, and positional accuracy of the respective members that are inserted into the support shaft 73 is also improved.

In the present embodiment, the drive switch device 70 that is applied to the printer portion 11 is described as one embodiment. The present invention is not limited to the present embodiment. It is to be understood that the present invention may be embodied with various changes and modifications that may occur to a person skilled in the art, without departing from the spirit and scope of the invention defined in the appended claims. For example, an assembly is applicable to any kind of apparatus, the assembly having at least such a structure that the support shaft 73 is attached to the support frame 120 in a state in which an elastic member such as a coil spring and a stopper 150 are inserted into the support shaft 73.

Figure 13A:
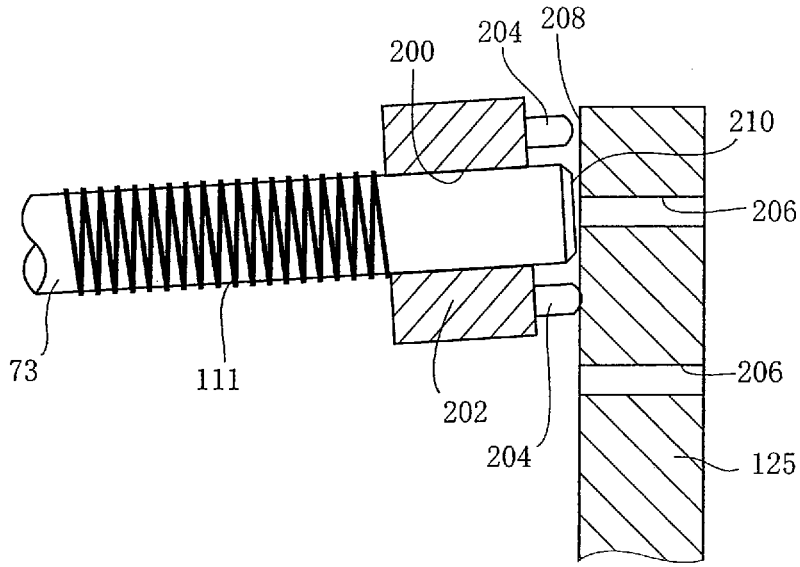
FIG. 13 is a cross-sectional view showing a structure of a device for supporting a support shaft by a first wall of an MFD as another embodiment to which the present invention is applied, especially FIG. 13A showing a state in which the support shaft is positioned in an inner side of the first wall, and FIG. 13B showing another state in which the support shaft is supported by the first wall.

Further, a structure that the support shaft 73 is supported by the second side wall 125 is not limited to the present embodiment. For example, a structure shown in FIGS. 13A and 13B can be adopted. In another embodiment shown in FIGS. 13A and 13B, an engaging protrusion 204, which is disposed in an engaging member 202 that is fitted onto the support shaft 73 at a fitting hole 200 of the engaging member 202, is engaged with an engaging holes 206 that is formed in the second side wall 125. As shown in FIG. 13A, the above-mentioned engagement can be realized when the engaging member 202 is positioned in an inner side of the second side wall 125 in a state in which the engaging member 202 is moved against the elastic force of the first coil spring 111. The engaging protrusion 204 has a circular shape in cross section and is rotatable in the engaging hole 206. Accordingly, a pair of the engaging protrusion 204 and the engaging hole 206 are provided on both sides of the fitting hole 200, i.e., two pairs of the engaging protrusions 204 and the engaging holes 206 are provided in total. The engagement of the two pairs of the engaging protrusions 204 and the engaging holes 206 prevents the engaging member 202 from moving relative to the first side wall 124 in all directions in parallel with an inner side surface 208. Further, since the engaging member 202 is maintained at a state in which the engaging member 202 is pressed on the inner side surface 208 by a biasing force of the first coil spring 111, the engaging member 202 is equivalent to be fixed to the second side wall 125. Therefore, one of opposite end portions of the support shaft 73 is supported by the second side wall 125 indirectly via the engaging member 202.

Figure 13B:
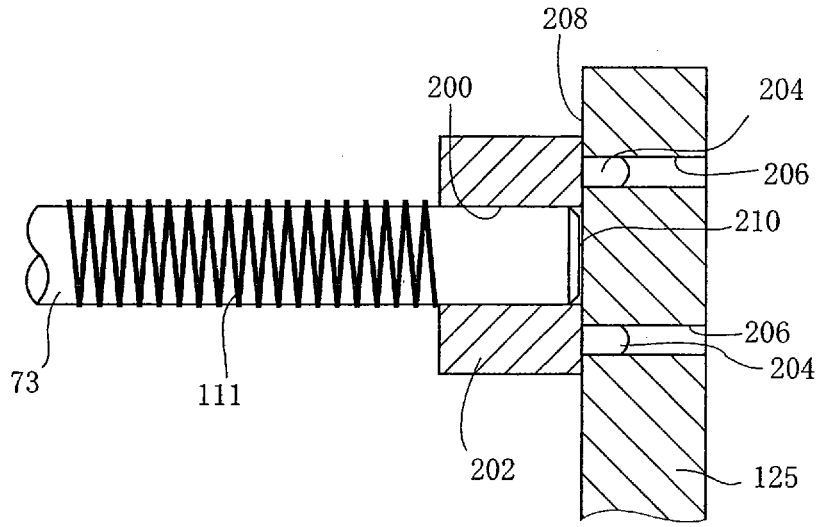

Furthermore, an end surface 210 of the support shaft 73 is in contact with the inner side surface 208 of the second side wall 125 or opposed to the same 208 by a slight distance, so that the support shaft 73 is prevented from moving in a right-hand direction in FIG. 13B. The support shaft 73 is prevented from moving in a left-hand direction in FIG. 13B when the shoulder 98 of the support shaft 73 is come into contact with the first side wall 124, similar to the illustrated embodiment. Therefore, the support shaft 73 is prevented from moving in two directions in parallel with the axis of the support shaft 73.

In FIGS. 13A and 13B, for easy understanding, the two pairs of the engaging protrusions 204 and the engaging holes 206 are spaced from each other in a direction parallel to a plane along which the support shaft 73 is pivoted during assembling. The present invention is not limited to the present embodiment. For example, the two pairs of the engaging protrusions 204 and the engaging holes 206 may be located at a position that is rotated by ninety degrees relative to states shown in FIGS. 13A, 13B.

Furthermore, the similar object can be achieved in a case where, on a circumference of one of opposite openings of a fitting hole of an engaging member that is close to the second side wall 125, there is formed an annular protrusion having a polygonal shape (for example, a quadrangle shape or a hexagonal shape) as an external shape in cross section, whereas a fitting hole in which the protrusion is unrotatably fitted is formed in the second side wall 126.

Figure 14:
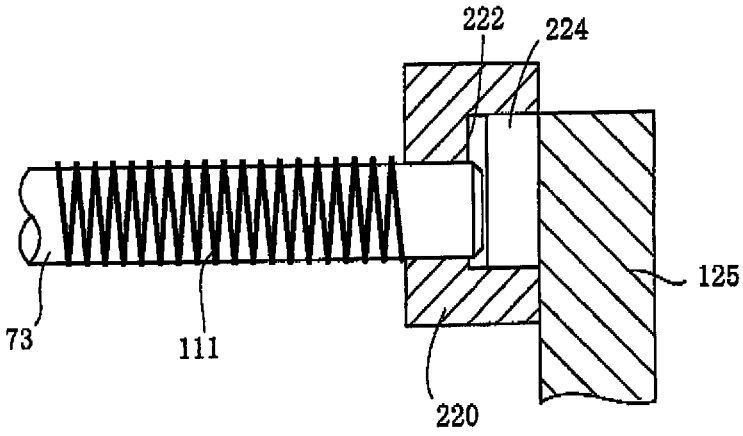
FIG. 14 is a cross-sectional view showing a structure of a device as a further embodiment in which a recess is formed in the engaging member and a protrusion is formed on the second side wall.

Further, as shown in FIG. 14, it will be possible to form a recess 222 in the engaging member 220 and form a protrusion 224 having a quadrangle shape in cross section, on the second side wall 125.

What is claimed is:

1. An assembly comprising:

a frame which includes a first wall and a second wall that are opposed to each other;

a support shaft which is supported by the first wall and the second wall at two respective portions of the support shaft that are spaced from each other in an axial direction thereof;

an elastic member which is supported by the support shaft;

an engaging member which is supported by the support shaft at a side of the elastic member that is closer to the second wall, wherein the engaging member is slidable with respect to the support shaft in the axial direction thereof; and wherein the engaging member includes a first engaging portion in one of opposite sides thereof that is apart from the elastic member and the first engaging portion is slidable with respect to the support shaft in the axial direction thereof, wherein the first wall has a recessed portion which is formed in an inner side surface of the first wall that is opposed to the second wall, and the second wall has a second engaging portion which is engageable with the first engaging portion so as to determine a position of the engaging member relative to the second wall in at least one direction that is in parallel with a wall surface of the second wall, and a limit of movement of the engaging member in a direction away from the first wall;

wherein the support shaft includes an insertion portion in one of opposite end portions thereof that can be fitted into the recessed portion;

wherein the first engaging portion and the second engaging portion are engaged with each other at a position spaced apart from the support shaft in a state in which the insertion portion is fitted into the recessed portion and the elastic member is compressed by the engaging member;

wherein the engaging member includes a first connecting portion as the first engaging portion, the second wall includes a cutout which is formed from one of opposite end edges of the second wall toward a center thereof and a second connecting portion as the second engaging portion that is provided in the vicinity of the cutout, and the support shaft includes an engaging groove; and wherein, in a state in which the engaging groove and an edge portion of the cutout are engaged with each other, the first connecting portion and the second connecting portion are connected with each other.

2. The assembly according to claim 1, wherein the engaging member includes a first connecting portion as the first engaging portion, and the second wall includes a second connecting portion as the second engaging portion that is connectable with the first connecting portion, and wherein the first connecting portion and the second connecting portion are connected with each other.

3. The assembly according to claim 1, wherein the second wall includes a cutout which is formed from one of opposite end edges of the second wall toward a center thereof, and the support shaft includes an engaging groove that is engageable with an edge portion of the cutout, and wherein, when the engaging groove and the edge portion of the cutout are engaged with each other, a position of the support shaft in the axial direction is determined and a movement of the support shaft in a direction perpendicular to a direction in which the cutout extends is prevented.

4. The assembly according to claim 3, wherein the engaging groove is formed in the other end portion of the support shaft that is opposite to the one end portion in which the insertion portion is formed.

5. The assembly according to claim 1, wherein the engaging member further includes a handle portion which extends in a direction away from a surface of the support shaft.

6. An assembly comprising:

a frame which includes a first wall and a second wall that are opposed to each other;

a support shaft which is supported by the first wall and the second wall at two respective portions of the support shaft that are spaced from each other in an axial direction thereof;

an elastic member which is supported by the support shaft; and an engaging member which is supported by the support shaft at a side of the elastic member that is closer to the second wall, wherein the engaging member includes a first engaging portion in one of opposite sides thereof that is apart from the elastic member, wherein the first wall has a recessed portion which is formed in an inner side surface of the first wall that is opposed to the second wall, and the second wall has a second engaging portion which is engageable with the first engaging portion so as to determine a position of the engaging member relative to the second wall in at least one direction that is in parallel with a wall surface of the second wall, and a limit of movement of the engaging member in a direction away from the first wall, wherein the support shaft includes an insertion portion in one of opposite end portions thereof that can be fitted into the recessed portion, wherein the first engaging portion and the second engaging portion are engaged with each other in a state in which the insertion portion is fitted into the recessed portion and the elastic member is compressed by the engaging member, wherein the engaging member includes a first connecting portion as the first engaging portion, the second wall includes a cutout which is formed from one of opposite end edges of the second wall toward a center thereof and a second connecting portion as the second engaging portion that is provided in the vicinity of the cutout, and the support shaft includes an engaging groove, wherein, in a state in which the engaging groove and an edge portion of the cutout are engaged with each other, the first connecting portion and the second connecting portion are connected with each other, wherein the second connecting portion includes a bridge portion which is provided in an outer space of the second wall that is opposite to the first wall and extends over the cutout, and wherein the first connecting portion includes a pair of holding claws which nip and hold the bridge portion from both sides in a direction parallel to a direction in which the cutout extends.

7. The assembly according to claim 6, wherein at least one of the pair of holding claws is elastically deformable so as to be movable away from the other of the holding claws and has an engaging protrusion which protrudes from a surface of the one holding claw that is opposed to the other holding claw toward the other holding claw, and wherein elastically deforming of the at least one holding claw permits that the engaging protrusion and the bridge portion are engaged with each other.

8. The assembly according to claim 6, wherein at least one of the pair of holding claws that is close to the support shaft extends through the cutout to an outside of the second wall and holds the bridge portion.

9. The assembly according to claim 6, wherein at least one of the pair of holding claws functions as a handle portion that is held by fingers of an assembler for moving the engaging member.

10. An assembly comprising:

a frame which includes a first wall and a second wall that are opposed to each other;

a support shaft which is supported by the first wall and the second wall at two respective portions of the support shaft that are spaced from each other in an axial direction thereof;

an elastic member which is supported by the support shaft; and an engaging member which is supported by the support shaft at a side of the elastic member that is closer to the second wall, wherein the engaging member includes a first engaging portion in one of opposite sides thereof that is apart from the elastic member, wherein the first wall has a recessed portion which is formed in an inner side surface of the first wall that is opposed to the second wall, and the second wall has a second engaging portion which is engageable with the first engaging portion so as to determine a position of the engaging member relative to the second wall in at least one direction that is in parallel with a wall surface of the second wall, and a limit of movement of the engaging member in a direction away from the first wall, wherein the support shaft includes an insertion portion in one of opposite end portions thereof that can be fitted into the recessed portion, wherein the first engaging portion and the second engaging portion are engaged with each other in a state in which the insertion portion is fitted into the recessed portion and the elastic member is compressed by the engaging member, wherein the engaging member includes a first connecting portion as the first engaging portion, the second wall includes a cutout which is formed from one of opposite end edges of the second wall toward a center thereof and a second connecting portion as the second engaging portion that is provided in the vicinity of the cutout, and the support shaft includes an engaging groove, wherein, in a state in which the engaging groove and an edge portion of the cutout are engaged with each other, the first connecting portion and the second connecting portion are connected with each other, wherein the cutout includes a first cutout portion adjacent to the one of opposite end edges of the second wall and a second cutout portion which is connected to one of opposite ends of the first cutout portion that is remote from the one end edge of the second wall, and wherein a width of the second cutout portion is smaller than that of the first cutout portion, and the engaging groove is engageable with an edge portion of the second cutout portion.

11. The assembly according to claim 1, wherein the recessed portion is a through hole which is formed through the first wall, and a diameter of the insertion portion of the support shaft is smaller than that of an adjacent portion that is adjacent to the insertion portion such that a shoulder is formed between the insertion portion and the adjacent portion, and wherein, when the shoulder is come into contact with the inner side surface of the first wall, a limit of inserting of the insertion portion into the through hole is determined.

12. The assembly according to claim 1, wherein a switching gear and a switching member are supported by the support shaft on a side of the elastic member that is opposite to the engaging member, and wherein, when the switching member is operated to move the switching gear in a direction toward the engaging member against an elastic force of the elastic member, a position of the switching gear on the support shaft is changed.

* * * * *